US011694630B2

(12) United States Patent
Jin et al.

(10) Patent No.: US 11,694,630 B2
(45) Date of Patent: Jul. 4, 2023

(54) DISPLAY DEVICE AND METHOD OF DRIVING THE SAME

(71) Applicant: SAMSUNG DISPLAY CO., LTD., Yongin-si (KR)

(72) Inventors: Ja Kyoung Jin, Yongin-si (KR); Yu Chol Kim, Yongin-si (KR); Ji Hye Kim, Yongin-si (KR); Seong Oh Yeom, Yongin-si (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 0 days.

(21) Appl. No.: 17/859,555

(22) Filed: Jul. 7, 2022

(65) Prior Publication Data

US 2023/0088642 A1 Mar. 23, 2023

(30) Foreign Application Priority Data

Sep. 23, 2021 (KR) ..... 10-2021-0125861

(51) Int. Cl.
*G09G 3/3266* (2016.01)
*G09G 3/3233* (2016.01)

(52) U.S. Cl.
CPC ..... *G09G 3/3266* (2013.01); *G09G 3/3233* (2013.01); *G09G 2300/0426* (2013.01); *G09G 2300/0819* (2013.01); *G09G 2300/0842* (2013.01); *G09G 2300/0861* (2013.01); *G09G 2310/08* (2013.01); *G09G 2320/0233* (2013.01); *G09G 2340/0435* (2013.01)

(58) Field of Classification Search
None
See application file for complete search history.

(56) References Cited

U.S. PATENT DOCUMENTS

| | | | | |
|---|---|---|---|---|
| 11,056,049 | B2 * | 7/2021 | Kim | G09G 3/3233 |
| 11,056,060 | B2 * | 7/2021 | Kim | G09G 3/3291 |
| 11,211,011 | B2 * | 12/2021 | Kim | G09G 3/3266 |
| 2019/0340977 | A1 * | 11/2019 | Park | G09G 3/3266 |
| 2021/0049965 | A1 * | 2/2021 | Jeon | G09G 3/3233 |
| 2021/0241699 | A1 * | 8/2021 | Lee | G09G 3/3233 |

* cited by examiner

*Primary Examiner* — Sepehr Azari
(74) *Attorney, Agent, or Firm* — Cantor Colburn LLP

(57) ABSTRACT

A display device includes a display panel including a pixel coupled to first to fourth scan lines, an emission control line, and a data line, a scan driver which supplies a first scan signal to the first scan line, a second scan signal to the second scan line, a third scan signal to the third scan line, and a fourth scan signal to the fourth scan line, an emission driver which supplies an emission control signal to the emission control line, a data driver which supplies a data signal to the data line, and a timing controller which controls the scan driver, the emission driver, and the data driver. Each of the second and third scan signals has a gate-on level during a partial period of one frame, and is maintained at a gate-off level during a remaining period of the one frame, other than the partial period.

18 Claims, 13 Drawing Sheets

<DSP>

<SSP>

<DSP_1>

<DSP_2>

DISPLAY DEVICE AND METHOD OF DRIVING THE SAME

This application claims priority to Korean Patent Application No. 10-2021-0125861, filed on Sep. 23, 2021, and all the benefits accruing therefrom under 35 U.S.C. § 119, the content of which in its entirety is incorporated by reference.

BACKGROUND

1. Field

Embodiments of the disclosure relate to a display device and a method of driving the display device.

2. Description of the Related Art

A display device typically includes a plurality of pixels. Each of the pixels may include a plurality of transistors, and a light-emitting element and a capacitor electrically connected to the transistors. The transistors are turned on in response to respective signals provided through lines, and a driving current is generated by the turned-on transistors. The light-emitting element emits light in response to the driving current.

SUMMARY

Recently, a method of driving the display device at low frequency may be used to improve driving efficiency of a display device and reduce power consumption by the display device. Therefore, when the display device is driven at low frequency, a method that is capable of improving display quality is desired.

Various embodiments of the disclosure are directed to a display device that is capable of minimizing a luminance deviation.

An embodiment of the disclosure provides a display device including a display panel including a pixel coupled to a first scan line, a second scan line, a third scan line, a fourth scan line, an emission control line, and a data line, a scan driver which supplies a first scan signal to the first scan line, supplies a second scan signal to the second scan line, supplies a third scan signal to the third scan line, and supplies a fourth scan signal to the fourth scan line, an emission driver which supplies an emission control signal to the emission control line, a data driver which supplies a data signal to the data line, and a timing controller which controls driving of the scan driver, the emission driver, and the data driver. In such an embodiment, each of the second scan signal and the third scan signal has a gate-on level during a partial period of one frame, and each of the second scan signal and the third scan signal is maintained at a gate-off level during a remaining period of one frame, other than the partial period.

In an embodiment, the scan driver may include a first scan driver which supplies the first scan signal to the first scan line at a second frequency corresponding to an image refresh rate of the pixel, a second scan driver which supplies the second scan signal to the second scan line at the second frequency, a third scan driver which supplies the third scan signal to the third scan line at the second frequency, and a fourth scan driver which supplies the fourth scan signal to the fourth scan line at a first frequency different from the second frequency. In such an embodiment, the emission driver may supply the emission control signal to the emission control line at the first frequency, and the data driver may supply the data signal to the data line at the second frequency.

In an embodiment, the one frame may include a display-scan period and at least one self-scan period. In such an embodiment, the second scan signal may have a gate-on level during a first period of the display-scan period and the second scan signal may be maintained at a gate-off level during a remaining period of the display-scan period, other than the first period, and the third scan signal may have a gate-on level during a second period of the display-scan period and the third scan signal may be maintained at a gate-off level during a remaining period of the display-scan period, other than the second period.

In an embodiment, the first period and the second period may be successive to each other in the display-scan period.

In an embodiment, a width of each of the first period and the second period may correspond to 3 horizontal periods.

In an embodiment, the fourth scan signal may have a gate-on level a partial period of a third period of the display-scan period, and the fourth scan signal may be maintained at a gate-off level during a remaining period of the display-scan period, other than the partial period of the third period.

In an embodiment, the first period and the third period may overlap each other.

In an embodiment, the second period and the third period may overlap each other.

In an embodiment, the third period ma include a first sub-period, a second sub-period, and a third sub-period, and the fourth scan signal may have a gate-on level during the first to third sub-periods and have a gate-off level in a remaining period of the third period, other than the first to third sub-periods.

In an embodiment, the first scan signal may have a gate-on level during a fourth period of the display-scan period, the first scan signal may be maintained at a gate-off level during a remaining period of the display-scan period, other than the fourth period, and the data signal may be written to the pixel during the display-scan period.

In an embodiment, the second scan signal and the third scan signal may be maintained at a gate-off level during each of the at least one self-scan period.

In an embodiment, the fourth scan signal may have a gate-on level during at least a partial period of a sixth period of each of the at least one self-scan period and the fourth scan signal may be maintained at a gate-off level during a remaining period of each of the at least one self-scan period, other than at least the partial period of the sixth period.

In an embodiment, the second frequency may correspond to an aliquot of the first frequency.

In an embodiment, the image refresh rate may decrease as a number of the at least one self-scan period in the one frame increases.

In an embodiment, the pixel may include a first transistor including a gate electrode coupled to a first node, a first electrode coupled to a first power line, and a second electrode coupled to a third node, a first capacitor coupled between the first power line and a second node, a second capacitor coupled between the first node and the second node, a second transistor including a first electrode coupled to the data line, a second electrode coupled to the second node, and a gate electrode coupled to the first scan line, a third transistor including a first electrode coupled to the first node, a second electrode coupled to the third node, and a gate electrode coupled to the second scan line, a fourth transistor including a first electrode coupled to the first node, a second electrode coupled to an initialization power line, and a gate electrode coupled to the third scan line, a fifth transistor including a first electrode coupled to the second node, a second electrode coupled to a reference power line, and a gate electrode coupled to the second scan line, a sixth transistor including a first electrode coupled to the third node and a gate electrode coupled to the emission control line, a seventh transistor including a first electrode coupled to the initialization power line and a gate electrode coupled to the fourth scan line, and a light-emitting element including a first electrode coupled to a second electrode of the sixth transistor and to a second electrode of the seventh transistor and a second electrode coupled to a second power line.

An embodiment of the disclosure provides a method of driving a display device including supplying a first scan signal to a first scan line, supplying a second scan signal to a second scan line, supplying a third scan signal to a third scan line, supplying a fourth scan signal to a fourth scan line, supplying an emission control signal to an emission control line, and supplying a data signal to a pixel through a data line. In such an embodiment, each of the second scan signal and the third scan signal has a gate-on level during a partial period of one frame, and each of the second scan signal and the third scan signal is maintained at a gate-off level during a remaining period of one frame, other than the partial period.

In an embodiment, the supplying the first scan signal may include supplying the first scan signal to the first scan line at a second frequency corresponding to an image refresh rate of the pixel, the supplying the second scan signal may include supplying the second scan signal to the second scan line at the second frequency, the supplying the third scan signal may include supplying the third scan signal to the third scan line at the second frequency, the supplying the fourth scan signal may include supplying the fourth scan signal to the fourth scan line at a first frequency different from the second frequency, the supplying the emission control signal may include the emission control signal to the emission control line at the first frequency, and the supplying the data signal may include supplying the data signal to the data line at the second frequency.

In an embodiment, the one frame may include a display-scan period and at least one self-scan period, the second scan signal may have a gate-on level during a first period of the display-scan period and the second scan signal may be maintained at a gate-off level during a remaining period of the display-scan period, other than the first period, and the third scan signal may have a gate-on level during a second period of the display-scan period and the third scan signal may be maintained at a gate-off level during a remaining period of the display-scan period, other than the second period.

In an embodiment, a width of each of the first period and the second period may correspond to 3 horizontal periods.

In an embodiment, the fourth scan signal may have a gate-on level during at least a partial period of a third period of the display-scan period and the fourth scan signal may be maintained at a gate-off level during a remaining period of the display-scan period, other than at least the partial period of the third period, the first period and the third period may overlap each other, and the second period and the third period may overlap each other.

DETAILED DESCRIPTION

Figure 1:
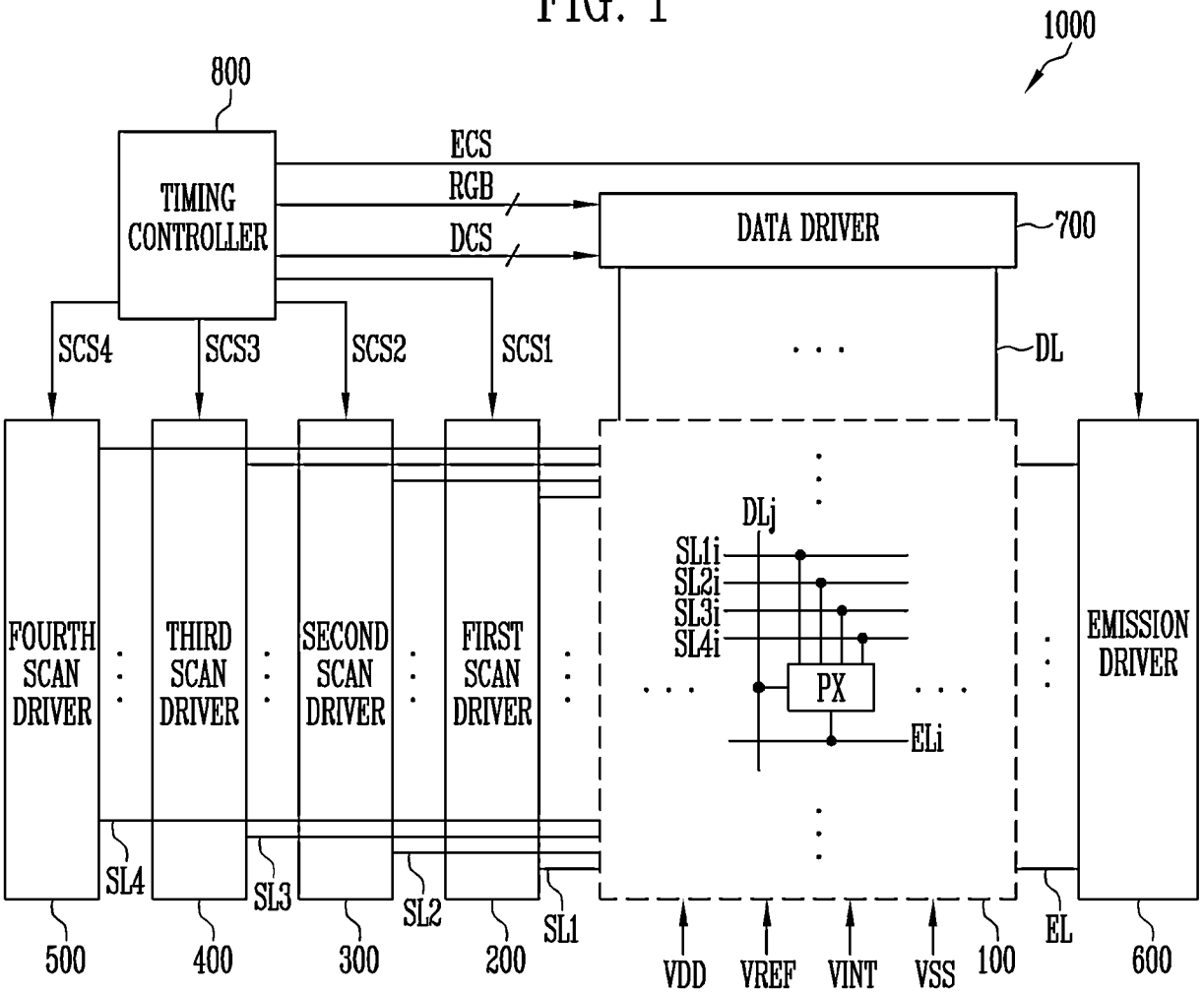
FIG. 1 is a block diagram illustrating a display device according to an embodiment of the disclosure.

The invention now will be described more fully hereinafter with reference to the accompanying drawings, in which various embodiments are shown. This invention may, however, be embodied in many different forms, and should not be construed as limited to the embodiments set forth herein. Rather, these embodiments are provided so that this disclosure will be thorough and complete, and will fully convey the scope of the invention to those skilled in the art.

It will be understood that when an element is referred to as being "on" another element, it can be directly on the other element or intervening elements may be present therebetween. In contrast, when an element is referred to as being "directly on" another element, there are no intervening elements present.

It will be understood that, although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

The terminology used herein is for the purpose of describing particular embodiments only and is not intended to be limiting. As used herein, "a", "an," "the," and "at least one" do not denote a limitation of quantity, and are intended to include both the singular and plural, unless the context clearly indicates otherwise. For example, "an element" has the same meaning as "at least one element," unless the context clearly indicates otherwise. "At least one" is not to be construed as limiting "a" or "an." "Or" means "and/or." As used herein, the term "and/or" includes any and all combinations of one or more of the associated listed items. It will be further understood that the terms "comprises"

and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The term "lower," can therefore, encompasses both an orientation of "lower" and "upper," depending on the particular orientation of the figure. Similarly, if the device in one of the figures is turned over, elements described as "below" or "beneath" other elements would then be oriented "above" the other elements. The terms "below" or "beneath" can, therefore, encompass both an orientation of above and below.

"About" or "approximately" as used herein is inclusive of the stated value and means within an acceptable range of deviation for the particular value as determined by one of ordinary skill in the art, considering the measurement in question and the error associated with measurement of the particular quantity (i.e., the limitations of the measurement system). For example, "about" can mean within one or more standard deviations, or within ±30%, 20%, 10% or 5% of the stated value.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Embodiments are described herein with reference to cross section illustrations that are schematic illustrations of idealized embodiments. As such, variations from the shapes of the illustrations as a result, for example, of manufacturing techniques and/or tolerances, are to be expected. Thus, embodiments described herein should not be construed as limited to the particular shapes of regions as illustrated herein but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

Hereinafter, embodiments of the disclosure will be described in detail with reference to the accompanying drawings. The same reference numerals are used to designate the same or similar components throughout the drawings, and any repetitive detailed descriptions thereof may be omitted or simplified.

FIG. 1 is a block diagram illustrating a display device according to an embodiment of the disclosure.

Referring to FIG. 1, an embodiment of a display device 1000 may include a display panel 100, scan drivers 200, 300, 400, and 500, an emission driver 600, a data driver 700, and a timing controller 800.

The scan drivers 200, 300, 400, and 500 may be divided into a first scan driver 200, a second scan driver 300, a third scan driver 400, and a fourth scan driver 500 based on the configuration and operation thereof. However, the division of the scan drivers is intended for convenience of description, and at least some of the scan drivers may be integrated with each other into a single driver circuit, a single module or the like according to the design.

In an embodiment, the display device 1000 may further include a power supply to supply the voltage of first power VDD, the voltage of second power VSS, the voltage of third power VREF (or reference power), and the voltage of fourth power VINT (or initialization power) to the display panel 100. The power supply may supply low power and high power for determining a gate-on level and a gate-off level for scan signals, control signals, and/or emission control signals to the scan drivers 200, 300, 400, and 500 and/or the emission driver 600. In an embodiment, the lower power may have a voltage level lower than a voltage level of the high power. However, this is only one embodiment, and alternatively, at least one of the first power VDD, the second power VSS, the initialization power VINT, the reference power VREF, low power, and high power may also be supplied from the timing controller 800 or the data driver 700.

In an embodiment, the source of the first power VDD and the source of the second power VSS may generate voltages for driving the light-emitting element. In an embodiment, the voltage level of the second power VSS may be lower than a voltage level of the first power VDD. In an embodiment, for example, the voltage of the first power VDD may be a positive voltage, and the voltage of the second power VSS may be a negative voltage.

The reference power VREF may be power for initializing a pixel PX. In an embodiment, for example, a capacitor and/or a transistor included in the pixel PX may be initialized by the voltage of the reference power VREF. The reference power VREF may be a positive voltage. In an embodiment, for example, the reference power VREF may have a voltage level identical to a level of the first power VDD or may be a direct-current ("DC") voltage having a specific voltage level.

The initialization power VINT may be power for initializing the pixel PX. In an embodiment, for example, a driving transistor and/or a light-emitting element included in the pixel PX may be initialized by the voltage of the initialization power VINT. The initialization power VINT may be a negative voltage. In an embodiment, for example, the initialization power VINT may have a voltage level lower than a voltage level of a data signal.

The display device 1000 may display an image at various image refresh rates (i.e., a refresh rate, a driving frequency or a screen display rate) depending on driving conditions. The image refresh rate may be the frequency at which a data signal is actually written to the driving transistor (a first transistor) of the pixel PX. In an embodiment, for example, the image refresh rate is also referred to as a scanning rate or a screen display frequency, and may represent the frequency at which a display image is repainted or refreshed per second.

In an embodiment, in accordance with the image reference rate, the output frequency of the data driver 700 for one horizontal line (or one pixel row) and/or the output frequency of the first scan driver 200 for outputting a write scan signal may be determined. In an embodiment, for example, the refresh rate for video driving may be a frequency of about 60 hertz (Hz) or higher (e.g., about 120 Hz, about 240 Hz, or the like).

In an embodiment, the display device 1000 may adjust the output frequencies of the scan drivers 200, 300, 400, and 500 for one horizontal line (or one pixel row) and the output frequency of the data driver 700 corresponding thereto depending on the driving conditions. In an embodiment, for example, the display device 1000 may display images in accordance with various image refresh rates of about 1 Hz to about 240 Hz. However, this is only one embodiment, and alternatively, the display device 1000 may also display an image at an image refresh rate of more than about 240 Hz (e.g., about 480 Hz).

The display panel 100 may include pixels PX coupled (or connected) to data lines DL, scan lines SL1, SL2, SL3, and SL4, and emission control lines EL. The pixels PX may be supplied with voltages of the first power VDD, the second power VSS, the initialization power VINT, and the reference power VREF from an external device. In an embodiment, a pixel PX arranged in an i-th row and a j-th column (where i and j are natural numbers) may be coupled to scan lines SL1*i*, SL2*i*, SL3*i*, and SL4*i* corresponding to the i-th pixel row, an emission control line ELi corresponding to the i-th pixel row, and a data line DLj corresponding to the j-th pixel column.

In an embodiment of the disclosure, signal lines SL1, SL2, SL3, SL4, EL, and DL coupled to each pixel PX may be set in various forms to correspond to the circuit structure of the pixel PX.

The timing controller 800 may generate a first driving control signal SCS1, a second driving control signal SCS2, a third driving control signal SCS3, a fourth driving control signal SCS4, a fifth driving control signal ECS, and a sixth driving control signal DCS in response to synchronization signals supplied from an external device. The first driving control signal SCS1 may be supplied to the first scan driver 200, the second driving control signal SCS2 may be supplied to the second scan driver 300, the third driving control signal SCS3 may be supplied to the third scan driver 400, the fourth driving control signal SCS4 may be supplied to the fourth scan driver 500, the fifth driving control signal ECS may be supplied to the emission driver 600, and the sixth driving control signal DCS may be supplied to the data driver 700. In an embodiment, the timing controller 800 may realign input image data supplied from an external device into image data RGB, and may supply the image data RGB to the data driver 700.

The first driving control signal SCS1 may include a first scan start pulse and clock signals. The first scan start pulse may control first timing of a scan signal output from the first scan driver 200. The clock signals may be used to shift the first scan start pulse.

The second driving control signal SCS2 may include a second scan start pulse and clock signals. The second scan start pulse may control first timing of a scan signal output from the second scan driver 300. The clock signals may be used to shift the second scan start pulse.

The third driving control signal SCS3 may include a third scan start pulse and clock signals. The third scan start pulse may control first timing of a scan signal output from the third scan driver 400. The clock signals may be used to shift the third scan start pulse.

The fourth driving control signal SCS4 may include a fourth scan start pulse and clock signals. The fourth scan start pulse may control first timing of a scan signal output from the fourth scan driver 500. The clock signals may be used to shift the fourth scan start pulse.

The fifth driving control signal ECS may include an emission control start pulse and clock signals. The emission control start pulse may control first timing of the emission control signal output from the emission driver 600. The clock signals may be used to shift the emission control start pulse.

The sixth driving control signal DCS may include a source start pulse and clock signals. The source start pulse may control the time point at which the sampling of data starts. The clock signals may be used to control a sampling operation.

The first scan driver 200 may receive the first driving control signal SCS1 from the timing controller 800, and may supply a scan signal (e.g., a first scan signal) to the first scan lines SL1 in response to the first driving control signal SCS1. In an embodiment, for example, the first scan driver 200 may sequentially supply the first scan signal to the first scan lines SL1. When the first scan signal is sequentially supplied, the pixels PX may be selected on a horizontal line-by-horizontal line basis (or a pixel row-by-pixel row basis), and a data signal may be supplied to the pixels PX. In such an embodiment, the first scan signal may be a signal used to write data.

The first scan signal may be set to a gate-on level (e.g., a low level). A transistor that is included in a pixel PX and receives the first scan signal may be set to a turn-on state when the first scan signal is supplied.

In an embodiment, in accordance with one scan line (e.g., the first scan line SL1*i*) among the first scan lines SL1, the first scan driver 200 may supply a scan signal (e.g., a first scan signal) to the first scan line SL1*i* at a same frequency (e.g., a second frequency) as the image refresh rate of the display device 1000. The second frequency may be set to an aliquot or divisor of the first frequency at which the emission driver 600 is driven.

The first scan driver 200 may supply the scan signal to the first scan lines SL1 during a display-scan period in one frame. In an embodiment, for example, the first scan driver 200 may supply at least one scan signal to each of the first scan lines SL1 during the display-scan period.

The second scan driver 300 may receive the second driving control signal SCS2 from the timing controller 800, and may supply a scan signal (e.g., a second scan signal) to the second scan lines SL2 in response to the second driving control signal SCS2. In an embodiment, for example, the second scan driver 300 may sequentially supply the second scan signal to the second scan lines SL2. The second scan signal may be supplied for initialization of the pixels PX and/or sampling or compensation of threshold voltages (Vth). When the second scan signal is supplied, the pixels PX may perform an operation of sampling (or compensating) the threshold voltages and/or an initialization operation.

The second scan signal may be set to a gate-on level (e.g., a low level). A transistor that is included in a pixel PX and receives the second scan signal may be set to a turn-on state when the second scan signal is supplied.

In an embodiment, in accordance with one scan line (e.g., the second scan line SL2*i*) among the second scan lines SL2, the second scan driver 300 may supply a scan signal (e.g., a second scan signal) to the second scan line SL2*i* at a same frequency (e.g., the second frequency) as the output of the first scan driver 200.

The second scan driver 300 may supply the scan signal to the second scan lines SL2 during a display-scan period in one frame. In an embodiment, for example, the second scan driver 300 may supply at least one scan signal to each of the second scan lines SL2 during the display-scan period.

In an embodiment, the second scan driver 300 may supply a second scan signal having a gate-on level (e.g., a low level) during at least a partial period of one frame (e.g., at least a part of the display-scan period in one frame), and may supply a second scan signal having a gate-off level (e.g., a high level) during the remaining period of one frame, other than at least the partial period of one frame. That is, the second scan signal provided to the second scan lines SL2 may be maintained at a gate-off level during the display-scan period of one frame, except for at least the partial period.

The third scan driver 400 may receive the third driving control signal SCS3 from the timing controller 800, and may supply a scan signal (e.g., a third scan signal) to the third scan lines SL3 in response to the third driving control signal SCS3. In an embodiment, for example, the third scan driver 400 may sequentially supply the third scan signal to the third scan lines SL3. The third scan signal may be supplied to initialize the pixels PX. When the third scan signal is supplied, the pixels PX may perform an initialization operation.

The third scan signal may be set to a gate-on level (e.g., a low level). A transistor that is included in a pixel PX and receives the third scan signal may be set to a turn-on state when the third scan signal is supplied.

In an embodiment, in accordance with one scan line (e.g., the third scan line SL3*i*) among the third scan lines SL3, the third scan driver 400 may supply a scan signal (e.g., a third scan signal) to the third scan line SL3*i* at a same frequency (e.g., the second frequency) as the output of the first scan driver 200.

The third scan driver 400 may supply the scan signal to the third scan lines SL3 during a display-scan period in one frame. In an embodiment, for example, the third scan driver 400 may supply at least one scan signal to each of the third scan lines SL3 during the display-scan period.

In an embodiment, the third scan driver 400 may supply a third scan signal having a gate-on level (e.g., a low level) during at least a partial period of one frame (e.g., at least a part of the display-scan period in one frame), and may supply a third scan signal having a gate-off level (e.g., a high level) during the remaining period of one frame, other than at least the partial period of one frame. That is, the third scan signal provided to the third scan lines SL3 may be maintained at a gate-off level during the display-scan period of one frame, except for at least the partial period.

The fourth scan driver 500 may receive the fourth driving control signal SCS4 from the timing controller 800, and may supply a scan signal (e.g., a fourth scan signal) to the fourth scan lines SL4 in response to the fourth driving control signal SCS4. In an embodiment, for example, the fourth scan driver 500 may sequentially supply the fourth scan signal to the fourth scan lines SL4. The fourth scan signal may be supplied to initialize light-emitting elements included in the pixels PX. When the fourth scan signal is supplied, the pixels PX may perform an operation of initializing the light-emitting elements.

The fourth scan signal may be set to a gate-on level (e.g., a low level). A transistor that is included in a pixel PX and receives the fourth scan signal may be set to a turn-on state when the fourth scan signal is supplied.

In an embodiment, in accordance with one scan line (e.g., the fourth scan line SL4*i*) among the fourth scan lines SL4, the fourth scan driver 500 may always supply a scan signal (e.g., the fourth scan signal) to the fourth scan line SL4*i* at a constant frequency (e.g., a first frequency) regardless of the frequency of the image refresh rate of the display device 1000.

In an embodiment, the first frequency at which the fourth scan driver 500 supplies the scan signal may be set to be higher than the second frequency. In an embodiment, the frequency (and the second frequency) of the image refresh rate may be set to an aliquot or divisor of the first frequency.

In an embodiment, for example, at all driving frequencies at which the display device 1000 may be driven, the fourth scan driver 500 may perform scanning once during a display-scan period, and may perform scanning at least once according to the image refresh rate during a self-scan period.

In such an embodiment, scan signals may be sequentially output once to respective fourth scan lines SL4 during the display-scan period, and scan signals may be sequentially output once or more to respective fourth scan lines SL4 during the self-scan period.

In an embodiment, when the image refresh rate decreases, the number of repetitions of an operation in which the fourth scan driver 500 supplies scan signals to respective fourth scan lines SL4 in one frame period may increase.

In an embodiment, the fourth scan driver 500 may supply the fourth scan signal having a gate-on level (e.g., a low level) during a period overlapping a period during which the second scan driver 300 supplies the second scan signal having a gate-on level. In such an embodiment, the fourth scan driver 500 may supply the fourth scan signal having a gate-on level (e.g., a low level) during a period overlapping a period during which the third scan driver 400 supplies the third scan signal having a gate-on level.

The emission driver 600 may receive the fifth driving control signal ECS from the timing controller 800, and may supply the emission control signal to the emission control lines EL in response to the fifth driving control signal ECS. In an embodiment, for example, the emission driver 600 may sequentially supply the emission control signal to the emission control lines EL.

When the emission control signal is supplied, the pixels PX may be non-emissive on a horizontal line-by-horizontal line basis (or a pixel row-by-pixel row basis). In such an embodiment, when the emission control signal is supplied, the emission control signal may be set to a gate-off level (e.g., a high level) so that transistors included in the pixels PX are turned off. A transistor that is included in a pixel PX and receives the emission control signal may be turned off in a case where the emission control signal is supplied, and may be set to a turn-on state in other cases.

The emission control signal may be used to control the emission time of the pixels PX. In an embodiment, the emission control signal may be set to have a width greater than a width of the scan signal.

In an embodiment, similar to the fourth scan driver 500, in accordance with one emission control line (e.g., the emission control line ELi), among the emission control lines EL, the emission driver 600 may supply the emission control signal at first frequency to the emission control line ELi. Therefore, in one frame period, the emission control signals supplied to respective emission control lines E may be repeatedly supplied at intervals of a predetermined period.

Accordingly, when the image refresh rate decreases, the number of repetitions of the operation in which the emission driver 600 supplies emission control signals to respective emission control lines EL in one frame period may increase.

The data driver 700 may receive the sixth driving control signal DCS and image data RGB from the timing controller 800. The data driver 700 may supply data signals to the data lines DL in response to the sixth driving control signal DCS. The data signals supplied to the data lines DL may be supplied to the pixels PX selected by a scan signal (e.g., a first scan signal). In such an embodiment, the data driver 700 may supply data signals to the data lines DL in synchronization with the scan signals.

In an embodiment, the data driver 700 may supply data signals to the data lines DL in one frame period in accordance with the image refresh rate. In an embodiment, for example, the data driver 700 may supply data signals in synchronization with scan signals supplied to the first scan lines SL1.

Figure 2A:
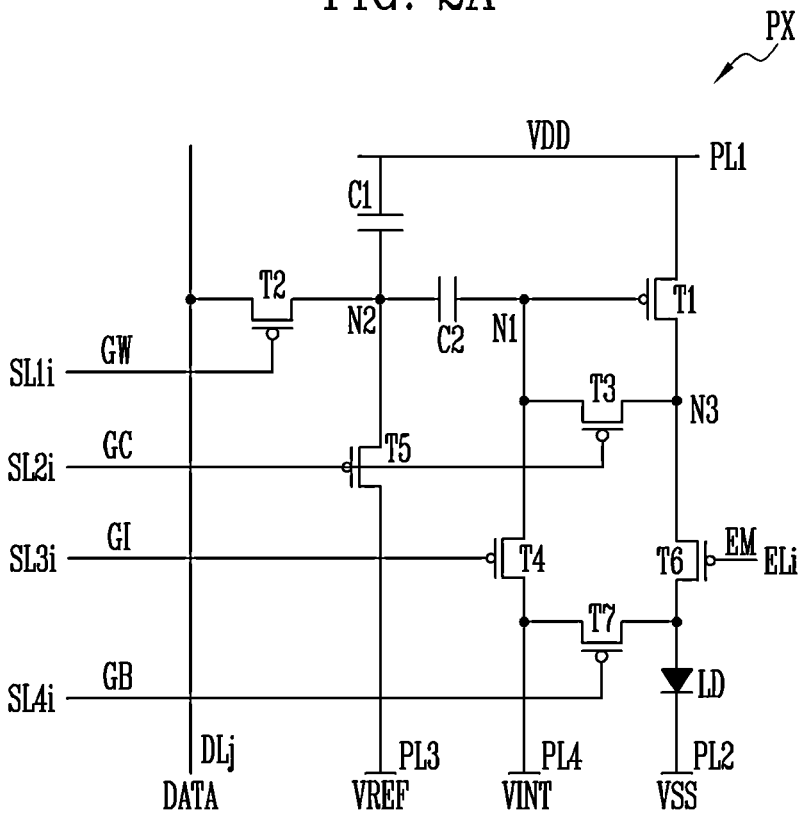
FIG. 2A is a circuit diagram illustrating an embodiment of a pixel included in the display device of FIG. 1.
Figure 2B:
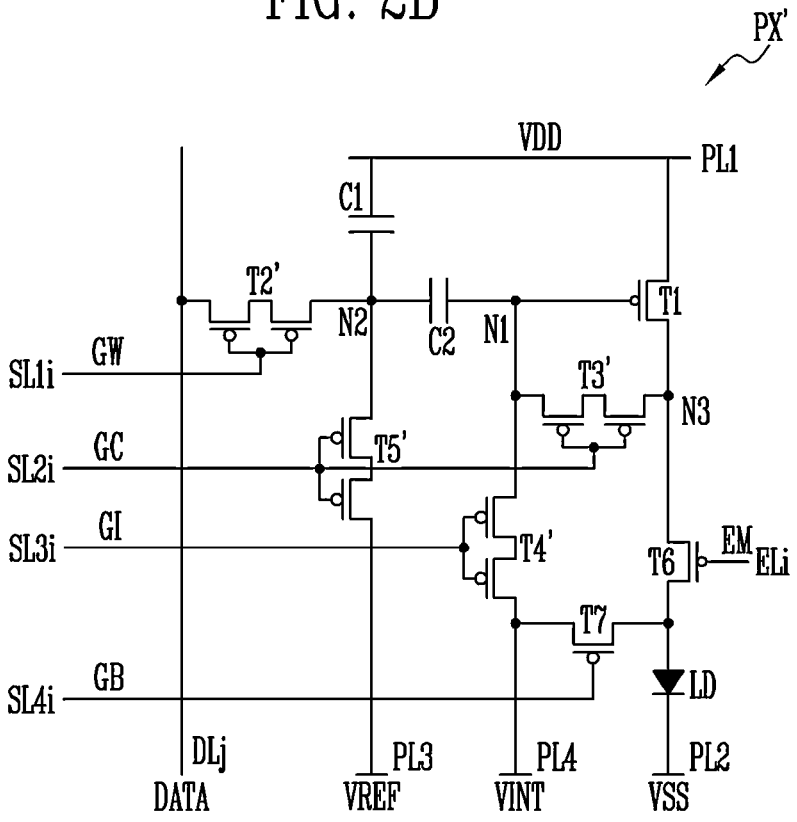
FIG. 2B is a circuit diagram illustrating an alternative embodiment of a pixel included in the display device of FIG. 1.

FIG. 2A is a circuit diagram illustrating an embodiment of a pixel included in the display device of FIG. 1. FIG. 2B is a circuit diagram illustrating an alternative embodiment of a pixel included in the display device of FIG. 1. In FIGS. 2A and 2B, for convenience of illustration and description, a pixel PX disposed in an i-th pixel row and a j-th pixel column is illustrated.

In an embodiment, referring to FIG. 2A, the pixel PX may include a light-emitting element LD and a pixel circuit (or a pixel driving circuit) which controls the amount of current flowing through the light-emitting element LD.

The light-emitting element LD may be coupled between a source of the first power VDD and a source of the second power VSS. In an embodiment, for example, a first electrode (e.g., an anode electrode) of the light-emitting element LD may be coupled to a first power line PL1 to which the voltage of the first power VDD is applied via the pixel circuit, and a second electrode (e.g., a cathode electrode) of the light-emitting element LD may be coupled to a second power line PL2 to which the voltage of the second power VSS is applied. The light-emitting element LD may emit light with luminance corresponding to a driving current provided from the pixel circuit.

The voltage of the first power VDD and the voltage of the second power VSS may have a potential difference that enables the light-emitting element LD to emit light. In an embodiment, for example, the first power VDD may be the power of a high-potential pixel, and the second power VSS may be the power of a low-potential pixel having a potential lower than a potential of the first power VDD by the threshold voltage of the light-emitting element LD or more.

In an embodiment, the light-emitting element LD may be an organic light-emitting diode. Alternatively, the light-emitting element LD may be an inorganic light-emitting diode, such as a micro-light-emitting diode or a quantum dot light-emitting diode. In an embodiment, the light-emitting element LD may be an element in which an organic material and an inorganic material are combined with each other. In an embodiment, as shown in FIG. 2A, the pixel PX may include a single light-emitting element LD, but alternatively, the pixel PX may include a plurality of light-emitting elements, which may be connected in series to each other, in parallel to each other, or in series-parallel to each other.

The pixel circuit may include at least one transistor and at least one capacitor. In an embodiment, the pixel circuit may include a first transistor T1 (or a driving transistor), a second transistor T2, a third transistor T3, a fourth transistor T4, a fifth transistor T5, a sixth transistor T6 (or a light-emitting transistor), a seventh transistor T7 (or an initialization transistor), a first capacitor C1 (or a storage capacitor), and a second capacitor C2. Each of the first transistor T1, the second transistor T2, the third transistor T3, the fourth transistor T4, the fifth transistor T5, the sixth transistor T6, and the seventh transistor T7 may be a P-type transistor (e.g., P-type metal-oxide-semiconductor field-effect transistor ("MOSFET")). However, the disclosure is not limited thereto, and alternatively, at least one of the transistors may be an N-type transistor.

The first transistor T1 may include a first electrode coupled to the first power line PL1, a second electrode coupled to a third node N3, and a gate electrode coupled to a first node N1. The voltage of the first power VDD may be applied to the first power line PL1. The first transistor T1 may control the amount of driving current flowing through the light-emitting element LD in response to a source-gate voltage (i.e., a voltage between the first electrode and the gate electrode).

The first capacitor C1 may be coupled or formed between the first power line PL1 and a second node N2. The first capacitor C1 may store a voltage provided to the second node N2, and may stabilize the voltage of the second node N2. The second capacitor C2 may be coupled between the first node N1 and the second node N2. The second capacitor C2 may store a voltage provided to the first node N1 and the second node N2.

The second transistor T2 may include a first electrode coupled to a data line DLj, a second electrode coupled to the second node N2, and a gate electrode coupled to the first scan line SL1*i*. The second transistor T2 may be turned on in response to a first scan signal GW having a gate-on level (e.g., a low level), provided through the first scan line SL1*i*, and may provide a data signal DATA applied to the data line DLj to the second node N2.

The third transistor T3 may include a first electrode coupled to the first node N1, a second electrode coupled to the third node N3, and a gate electrode coupled to a second scan line SL2*i*. The third transistor T3 may be turned on in response to a second scan signal GC having a gate-on level (e.g., a low level), provided through the second scan line SL2*i*, and may couple the first node N1 to the third node N3. In such an embodiment, the first transistor T1 may be connected in the form of a diode due to the third transistor T3. In this case, a voltage corresponding to a difference between the voltage of the first power VDD and the threshold voltage of the first transistor T1 may be sampled at the first node N1.

The fourth transistor T4 may include a first electrode coupled to the first node N1, a second electrode coupled to a fourth power line PL4 (or an initialization power line), and a gate electrode coupled to a third scan line SL3*i*. The voltage of the initialization power VINT may be applied to the fourth power line PL4. The fourth transistor T4 may be turned on in response to a third scan signal GI (or a first initialization control signal) having a gate-on level (e.g., a low level), provided through the third scan line SL3*i*, and may provide the voltage of the initialization power VINT to the first node N1. The initialization power VINT may have a voltage level lower than a voltage level of the data signal DATA. In an embodiment, for example, the voltage level of the initialization power VINT may be set to a level lower than the lowest voltage level of the data signal DATA. The fourth transistor T4 may initialize the first node N1 to the voltage of the initialization power VINT.

The fifth transistor T5 may include a first electrode coupled to the second node N2, a second electrode coupled to a third power line PL3 (or a reference power line), and a gate electrode coupled to the second scan line SL2*i*. The voltage of the reference power VREF may be applied to the third power line PL3. The fifth transistor T5 may be turned on in response to the second scan signal GC having a gate-on level (e.g., a low level), provided through the second scan line SL2*i*, and may provide the voltage of the reference power VREF to the second node N2. Here, the reference power VREF may have a voltage level identical to a voltage level of the first power VDD or may be a DC voltage having a specific voltage level. That is, the fifth transistor T5 may initialize the second node N2 to the voltage of the reference power VREF.

The sixth transistor T6 may include a first electrode coupled to the third node N3, a second electrode coupled to the first electrode (anode electrode) of the light-emitting element LD, and a gate electrode coupled to the emission control line ELi. The sixth transistor T6 may be turned on in response to an emission control signal EM having a gate-on level (or a low level), provided through the emission control line ELi, and may form a current movement path between the third node N3 and the light-emitting element LD. That is, when the sixth transistor T6 is turned on, a driving current may be provided to the light-emitting element LD, and the light-emitting element LD may emit light with luminance corresponding to the driving current. In such an embodiment, when the sixth transistor T6 is turned off, a current movement path for a driving current is blocked, and the light-emitting element LD may not emit light.

The seventh transistor T7 may include a first electrode coupled to the fourth power line PL4, a second electrode coupled to the first electrode (anode electrode) of the light-emitting element LD, and a gate electrode coupled to the fourth scan line SL4*i*. The seventh transistor T7 may be turned on in response to a fourth scan signal GB (or a second initialization control signal) having a gate-on level (e.g., a low level), provided through the fourth scan line SL4*i*, and may provide the voltage of the initialization power VINT to the first electrode (anode electrode) of the light-emitting element LD. When the voltage of the initialization power VINT is provided to the first electrode of the light-emitting element LD, charges stored in a parasitic capacitor formed in the light-emitting element LD (i.e., a parasitic capacitor occurring due to the structure of the light-emitting element LD) may be initialized by the voltage of the initialization power VINT. When the seventh transistor T7 transfers the voltage of the initialization power VINT to the first electrode (anode electrode) of the light-emitting element LD before an emission period in which the light-emitting element LD emits light, the pixel PX may show more uniform luminance characteristics in response to the data signal DATA.

In an embodiment, the first transistor T1, the second transistor T2, the third transistor T3, the fourth transistor T4, the fifth transistor T5, the sixth transistor T6, and the seventh transistor T7 may be formed as transistors having a similar structure and a similar size as each other. In an alternative embodiment, at least one of the first transistor T1, the second transistor T2, the third transistor T3, the fourth transistor T4, the fifth transistor T5, the sixth transistor T6, and the seventh transistor T7 may be formed as a transistor having a structure and a size different from those of the remaining transistors.

In an embodiment, at least one of the second transistor T2, the third transistor T3, the fourth transistor T4, and the fifth transistor T5 may be implemented as a dual-gate transistor (or a transistor including a plurality of sub-transistors connected in series to each other). In an embodiment, for example, as illustrated in FIG. 2B, each of a second transistor T2', a third transistor T3', a fourth transistor T4', and a fifth transistor T5' which are included in a pixel PX', may be implemented as a dual-gate transistor, and may include two series-connected sub-transistors. In such an embodiment, in a turn-off state of each of the third transistor T3' and the fourth transistor T4', a leakage current flowing through the third transistor T3' and the fourth transistor T4' may be decreased. In such an embodiment, a leakage current flowing through the second transistor T2' and the fifth transistor T5' may be decreased, and voltage variation in each of the second node N2 and the first node N1 (i.e., the first node N1 which is capacitor-coupled to the second node N2) may be decreased.

Figure 3:
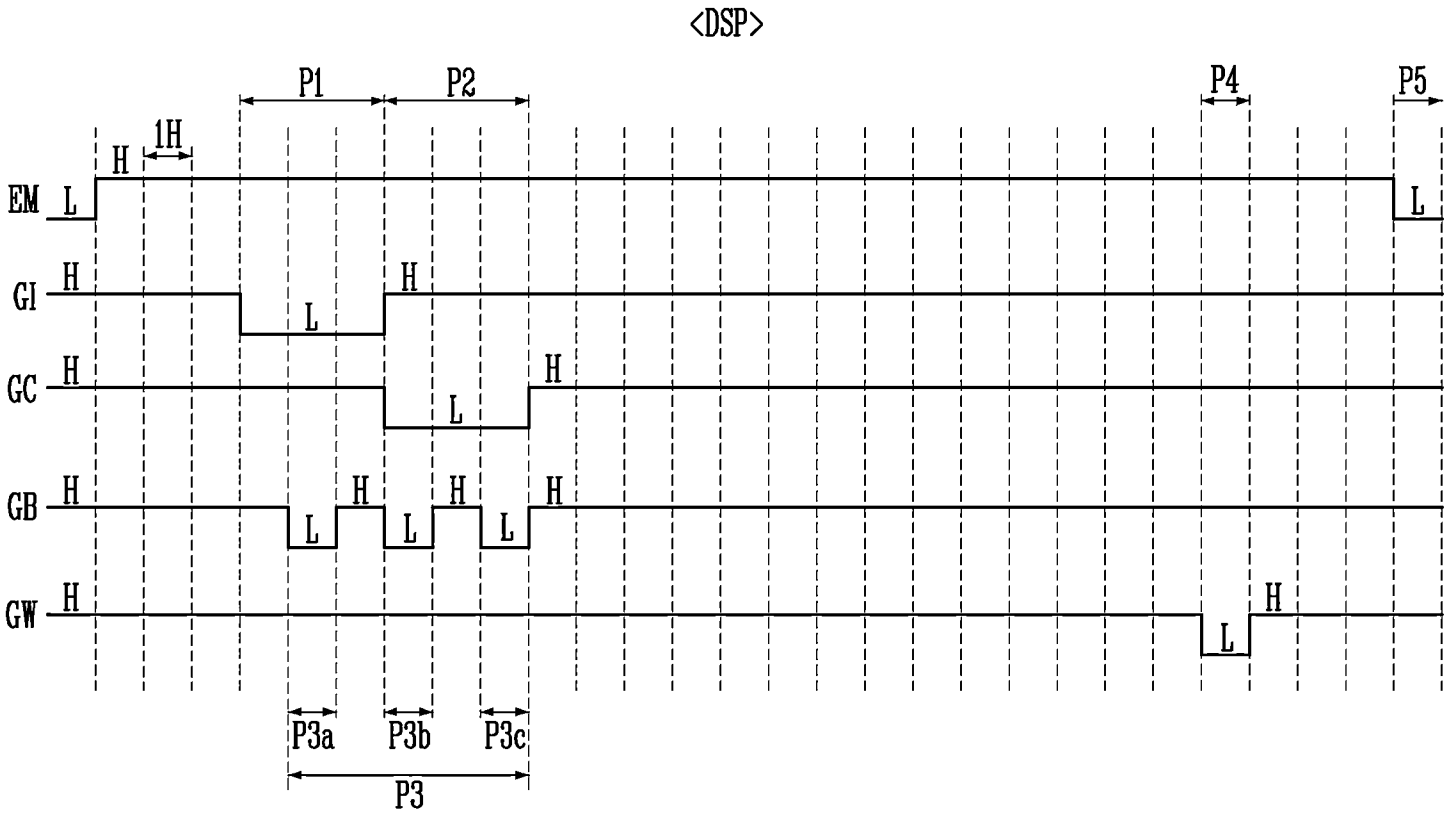
FIG. 3 is a waveform diagram illustrating an embodiment of the operation of the pixel of FIG. 2A in a display-scan period.

FIG. 3 is a waveform diagram illustrating an embodiment of the operation of the pixel of FIG. 2A in a display-scan period.

Referring to FIGS. 2A and 3, an emission control signal EM, a first scan signal GW, a second scan signal GC, a third scan signal GI (or a first initialization control signal), and a fourth scan signal GB (or a second initialization control signal) are illustrated in FIG. 3. In an embodiment, as illustrated in FIG. 2A, the emission control signal EM may be provided through the emission control line ELi, the first scan signal GW may be provided through the first scan line SL1*i*, the second scan signal GC may be provided through the second scan line SL2*i*, the third scan signal GI may be provided through the third scan line SL3*i*, and the fourth scan signal GB may be provided through the fourth scan line SL4*i*.

The pixel PX may be supplied with signals for image display during a display-scan period DSP. The display-scan period DSP may include a period during which a data signal DATA actually corresponding to an output image is written.

In the display-scan period DSP, a period in which the emission control signal EM has a gate-off level (or high level H) (i.e., a non-emission period of the pixel PX) may include a first period P1, a second period P2, a third period P3, and a fourth period P4. Also, a period during which the emission control signal EM has a gate-on level (or low level L) (i.e., an emission period of the pixel PX) may include a fifth period P5. The first period P1, the second period P2, the third period P3, the fourth period P4, and the fifth period P5 may be included in the display-scan period DSP in one frame (or one frame period).

During the first period P1, the third scan signal GI may have a gate-on level (or low level L). That is, during the first period P1, the third scan signal GI may have a pulse at gate-on level (or a low level L).

In an embodiment, during the first period P1, the first scan signal GW and the second scan signal GC may have a gate-off level (or high level H).

In response to the third scan signal GI having a gate-on level, the fourth transistor T4 may be turned on, and the voltage of the initialization power INT may be provided to the first node N1. That is, the first node N1 may be initialized to the voltage of the initialization power VINT, and the voltage of the first node N1 (or the voltage of the gate electrode of the first transistor T1) may be identical to the voltage of the initialization power VINT.

In an embodiment where the first electrode (or the source electrode) of the first transistor T1 is coupled to the first power line PL1, the voltage of the source electrode of the first transistor T1 may be identical to the voltage of the first power VDD.

In such an embodiment, the second node N2 may have the voltage of a previous data signal (i.e., a data signal of a previous frame) due to the first capacitor C1.

That is, during the first period P1, the first node N1 (or the gate electrode of the first transistor T1) may be initialized by the voltage of the initialization power VINT.

In an embodiment, the width (or length) of the first period P1 in which the third scan signal GI has a gate-on level may correspond to 3 horizontal periods (i.e., 3×1 horizontal period (1H)). Here, 3 horizontal periods (3H) may correspond to a period in which the first node N1 (or the gate electrode of the first transistor T1) is to be initialized in response to the third scan signal GI having a gate-on level. '1 horizontal period (1 H)' may correspond to the time allocated to apply a data signal to one pixel row, and the width of 1 horizontal period (1H) may be about 1.84 microseconds (μs) or less when the image refresh rate of the display device 1000 (see FIG. 1) is about 240 Hz.

During the second period P2, the second scan signal GC may have a gate-on level (or low level L). That is, during the second period P2, the second scan signal GC may have a pulse at gate-on level (or low level L).

In an embodiment, during the second period P2, each of the first scan signal GW and the third scan signal GI may have a gate-off level (or high level H).

In response to the second scan signal GC having a gate-on level, the fifth transistor T5 may be turned on, and the voltage of the reference power INT may be provided to the second node N2. That is, the second node N2 may be initialized to the voltage of the reference power VREF, and the voltage of the second node N2 may be changed to be equal to the voltage of the reference power VREF.

During the second period P2, the third transistor T3 may be turned on in response to the second scan signal GC having a gate-on level, and the gate electrode and the drain electrode (or the second electrode) of the first transistor T1 may be coupled to each other. That is, the first transistor T1 may be connected in the form of a diode or in a diode form. During the second period P2, a voltage corresponding to a difference (or a voltage difference) between the voltage of the first power VDD and the threshold voltage of the first transistor T1 may be sampled at the first node N1. The voltage of the first node N1 is similar to the voltage corresponding to the difference between the voltage of the first power VDD and the threshold voltage of the first transistor T1, but may be different from the difference between the voltage of the first power VDD and the threshold voltage of the first transistor T1. In an embodiment, for example, the voltage of the first node N1 may be represented by "VDD−Vth+α", where VDD denotes the voltage of the first power VDD, Vth denotes the threshold voltage of the first transistor T1, and a denotes a voltage component of a previous data signal caused by coupling of the second capacitor C2.

Since the voltage of the second node N2 is changed from the previous data signal to the voltage of the reference power VREF, a change in the voltage of the second node N2 may be transferred to the third node N1 through coupling of the second capacitor C2. Therefore, unlike an ideal sampling voltage (e.g., "VDD−Vth"), the voltage of the first node N1 may further include the voltage component of the previous data signal (i.e., change in the voltage of the second node N2).

In an embodiment, where the length of the second scan signal GC is 3 horizontal periods (3H), the threshold voltage of the first transistor T1 may be more accurately sampled, and may be accurately reflected in the data signal DATA.

In an embodiment, the second scan signal GC may have a waveform in which the third scan signal GI is shifted by the first period P1 (e.g., 3 horizontal periods (3H)). Therefore, the pulse width the second scan signal GC at gate-on level may correspond to 3 horizontal periods (3H), which is identical to the pulse width of the third scan signal GI at gate-on level.

In an embodiment, when the lengths of the first period P1 and/or the second period P2 are 4 horizontal periods (4H) or more, that is, when the length of a period in which the second scan signal GC and/or the third scan signal GI are maintained at the gate-on level (or low level) is 4 horizontal periods (4H) or more, the length of an initialization operation period is increased. Accordingly, the influence of bias on the first transistor T1 (e.g., the influence of on-bias) may be increased depending on signals supplied for the initialization operation, for example, the voltages of the initialization power VINT and the reference power VREF supplied to the pixel PX in response to the second scan signal GC having a gate-on level and the third scan signal GI having a gate-on level. Accordingly, because a shift in the threshold voltage of the first transistor T1 may be more severe, a luminance deviation in a display-scan period and a self-scan period and/or a luminance deviation depending on the image refresh rate and/or a luminance deviation depending on the image refresh rate may be deteriorated, which will be described in detail later with reference to FIGS. 7A, 7B, 8A, and 8B.

During at least part of the third period P3, the fourth scan signal GB may have a gate-on level (or low level L). During at least part of the third period P3, the fourth scan signal GB may have a pulse at gate-on level (or low level L).

In such an embodiment, during the third period P3, the first scan signal GW may have a gate-off voltage level (or high level H).

In response to the fourth scan signal GB having a gate-on level, the seventh transistor T7 may be turned on, and the voltage of the initialization power VINT may be provided to the first electrode (i.e., anode electrode) of the light-emitting element LD, such that charges stored in a parasitic capacitor formed in the light-emitting element LD (i.e., a parasitic capacitor occurring due to the structure of the light-emitting element LD) may be initialized due to the voltage of the initialization power VINT, and the pixel PX may show more uniform luminance characteristics.

In an embodiment, the fourth scan signal GB may have a plurality of pulses at gate-on level. In an embodiment, for example, during first to third sub-periods P3*a*, P3*b*, and P3*c* of the third period P3, the fourth scan signal GB may have pulses at gate-on level. In such an embodiment, the fourth scan signal GB may have three pulses at gate-on level (or at low level L) in the third period P3 in accordance with the first to third sub-periods P3*a*, P3*b*, and P3*c*. However, this is only one embodiment, and the disclosure is not limited thereto. In an alternative embodiment, for example, the fourth scan signal GB may have one, two or four or more pulses at gate-on level.

In an embodiment, the width of each of the gate-on level pulses of the fourth scan signal GB may correspond to 1 horizontal period (1 H). However, this is only one embodiment, and alternatively, the width of each of the gate-on level pulses of the fourth scan signal GB may be set to various values.

In an embodiment, at least part of the third period P3 may overlap the first period P1. In an embodiment, for example, the first sub-period P3*a* of the third period P3 may overlap the first period P1. Accordingly, during a partial period of the first period P1 in which the third scan signal GI has a gate-on level (e.g., a period in which the first period P1 overlaps the first sub-period P3*a*), the fourth scan signal GB may have a gate-on level (or low level L).

In an embodiment, at least part of the third period P3 may overlap the second period P2. In an embodiment, for example, the second sub-period P3*b* and the third sub-period P3*c* of the third period P3 may overlap the second period P2. Accordingly, during a partial period of the second period P2 in which the second scan signal GC has a gate-on level (e.g., a period in which the second period P2 overlaps the second sub-period P3*b* or the third sub-period P3*c*), the fourth scan signal GB may have a gate-on level (or low level L).

Because at least part of the third period P3 overlaps the first period P1 and/or the second period P2, an initialization operation in the third period P3 may be performed simultaneously with an initialization operation in the first period P1 and/or an initialization operation in the second period P2. Accordingly, in a non-emission period, the length of the initialization operation period for the pixel PX may be reduced.

However, this is only one embodiment, and a period overlapping the third period P3 is not limited thereto. In an alternative embodiment, for example, the third period P3 may overlap only the second period P2 without overlapping the first period P1, may overlap only the first period P1 without overlapping the second period P2, or may not overlap either of the first period P1 and the second period P2.

During the fourth period P4, the first scan signal GW may have a gate-on level (or low level L). That is, during the fourth period P4, the first scan signal GW may have a pulse at gate-on level. The pulse width of the first scan signal GW (or the width of the fourth period P4) may be 1 horizontal period (1H). Because the pulse width of the first scan signal GW is 1 horizontal period (1 H), the display device 1000 (see FIG. 1) may have higher resolution or may be operated at a higher driving frequency, without any structural change (e.g., addition of a data line).

In an embodiment, during the fourth period P4, the second scan signal GC, the third scan signal GI, and the fourth scan signal GB may have a gate-off level (or high level H).

In response to the first scan signal GW having a gate-on level, the second transistor T2 may be turned on, and a data signal DATA may be provided to the second node N2, such that the voltage of the second node N2 may be changed to a voltage corresponding to the data signal DATA.

Since the first node N1 is coupled to the second node N2 through the second capacitor C2, a change in the voltage of the second node N2 (i.e., "DATA−VREF") may be reflected in the first node N1. Therefore, the voltage of the first node N1 may be changed to "VDD−Vth+(DATA−VREF)".

During the fifth period P5, the emission control signal EM may have a gate-on level (or low level L), and each of the first scan signal GW, the second scan signal GC, the third scan signal GI, and the fourth scan signal GB may have a gate-off level (or high level H).

In response to the emission control signal EM having a gate-on level, the sixth transistor T6 may be turned on, and a current movement path may be formed between the third node N3 and the light-emitting element LD. In this case, a driving current may be provided to the light-emitting element LD, and the light-emitting element LD may emit light with luminance corresponding to the driving current. That is, the fifth period P5 may be an emission period (or a first emission period).

Figure 4:
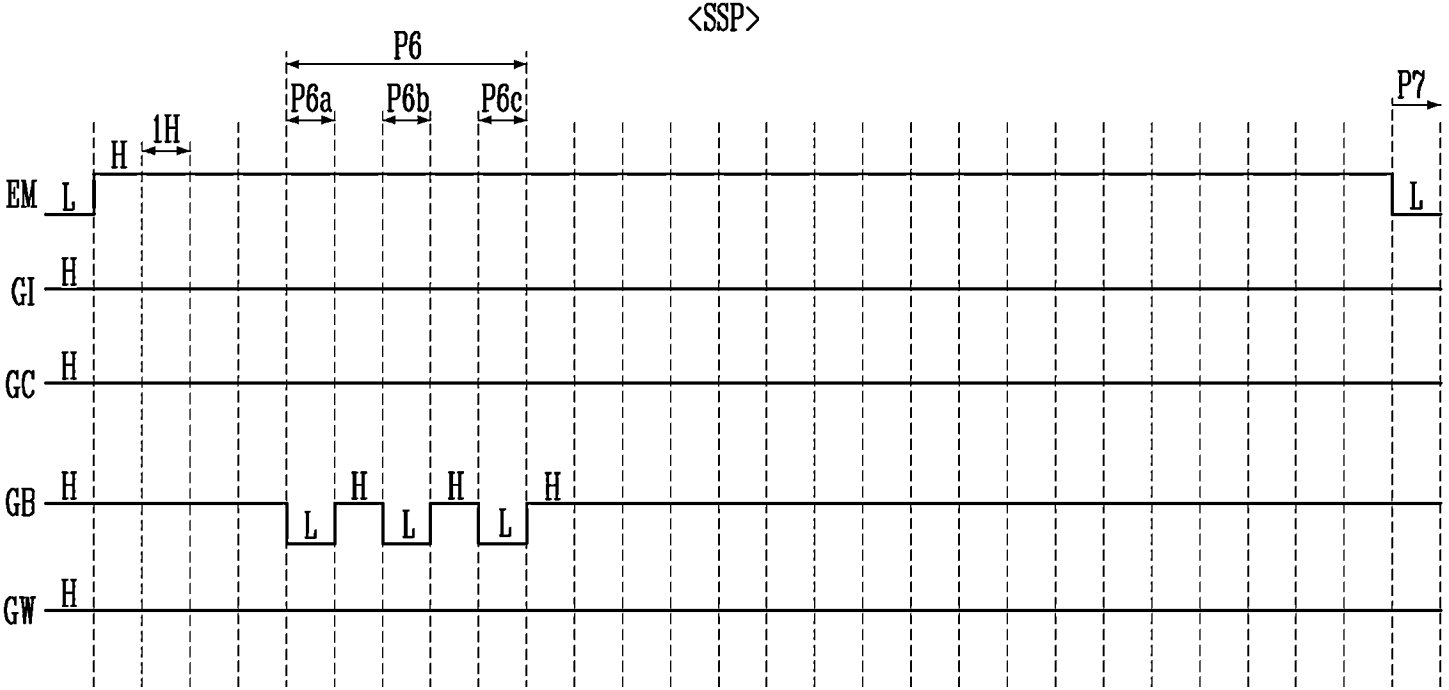
FIG. 4 is a waveform diagram illustrating an embodiment of the operation of the pixel of FIG. 2A in a self-scan period.

FIG. 4 is a waveform diagram illustrating an embodiment of the operation of the pixel of FIG. 2A in a self-scan period.

Referring to FIGS. 2A, 3, and 4, an emission control signal EM, a first scan signal GW, a second scan signal GC, a third scan signal GI (or a first initialization control signal), and a fourth scan signal GB (or a second initialization control signal) are illustrated in FIG. 4. As illustrated in FIG. 2A, the emission control signal EM may be provided through the emission control line ELi, the first scan signal GW may be provided through the first scan line SL1*i*, the second scan signal GC may be provided through the second scan line SL2*i*, the third scan signal GI may be provided through the third scan line SL3*i*, and the fourth scan signal GB may be provided through the fourth scan line SL4*i*.

In an embodiment, an initialization operation for the light-emitting element LD may be performed during a self-scan period SSP to maintain luminance of an image that is output during the display-scan period DSP.

One frame may include at least one self-scan period SSP depending on the image frame rate. The self-scan period SSP may include a sixth period P6 and a seventh period P7. In an embodiment, the operation in the self-scan period SSP of FIG. 4 is substantially the same as the operation in the display-scan period DSP of FIG. 3, except for the supply of signals for an initialization operation in the first period P1 of FIG. 3, the supply of signals for an initialization operation in the second period P2, and the supply of signals for data signal writing in the fourth period P4, and thus any repetitive detailed descriptions of the same operations will be omitted.

In an embodiment, during the self-scan period SSP, the first scan signal GW, the second scan signal GC, and the third scan signal GI may be maintained at a gate-off level (or high level H). Accordingly, the second transistor T2, the third transistor T3, the fourth transistor T4, and the fifth transistor T5 which are included in the pixel PX may remain turned off.

In an embodiment, during the self-scan period SSP, the third transistor T3 remains turned off, and thus voltage of the gate electrode of the first transistor T1 (i.e., the first node N1) is not influenced by driving of the self-scan period SSP.

In the self-scan period SSP, a period during which the emission control signal EM has a gate-off level (or high level H) (i.e., a non-emission period of the pixel PX) may include a sixth period P6. Also, a period during which the emission control signal EM has a gate-on level (or low level L) (i.e., an emission period of the pixel PX) may include a seventh period P7. The sixth period P6 and the seventh period P7 may be included in the self-scan period SSP in one frame (or one frame period).

During at least part of the sixth period P6 (e.g., first to third sub-periods P6*a*, P6*b* and P6*c* of the sixth period P6), the fourth scan signal GB may have a gate-on level (or a low level L). During at least part of the sixth period P6, the fourth scan signal GB may have a pulse at gate-on level (or low level L). The operation of the pixel PX in the sixth period P6 of the self-scan period SSP is substantially the same as the operation of the pixel PX in the third period P3 of the display-scan period DSP, described above with reference to FIG. 3, and thus any repetitive detailed descriptions thereof will be omitted.

During the seventh period P7, the emission control signal EM may have a gate-on level (or low level L), and each of the first scan signal GW, the second scan signal GC, the third scan signal GI, and the fourth scan signal GB may have a gate-off level (or high level H).

In response to the emission control signal EM having a gate-on level, the sixth transistor T6 may be turned on, and a current movement path may be formed between the third node N3 and the light-emitting element LD, such that a driving current may be provided to the light-emitting element LD, and the light-emitting element LD may emit light with luminance corresponding to the driving current. That is, the seventh period P7 may be an emission period (or a second emission period).

Here, the fourth scan signal GB and the emission control signal EM may be supplied at a first frequency regardless of an image refresh rate. Therefore, even in a case where the image refresh rate changes, an initialization operation for the light-emitting element LD (e.g., an initialization operation in the third period P3 of FIG. 3 and/or an initialization operation in the sixth period P6 of FIG. 4) may be continuously periodically performed. Therefore, in accordance with various image refresh rates (especially in low-frequency driving), an initialization operation is periodically performed on a parasitic capacitor formed in the light-emitting element LD, and thus the pixel PX may exhibit more uniform luminance characteristics during the display-scan period DSP and the self-scan period SSP.

In an embodiment, during the self-scan period SSP, the data driver 700 (see FIG. 1) may not supply a data signal to the pixel PX. As a result, power consumption may be further reduced.

Figure 5A:
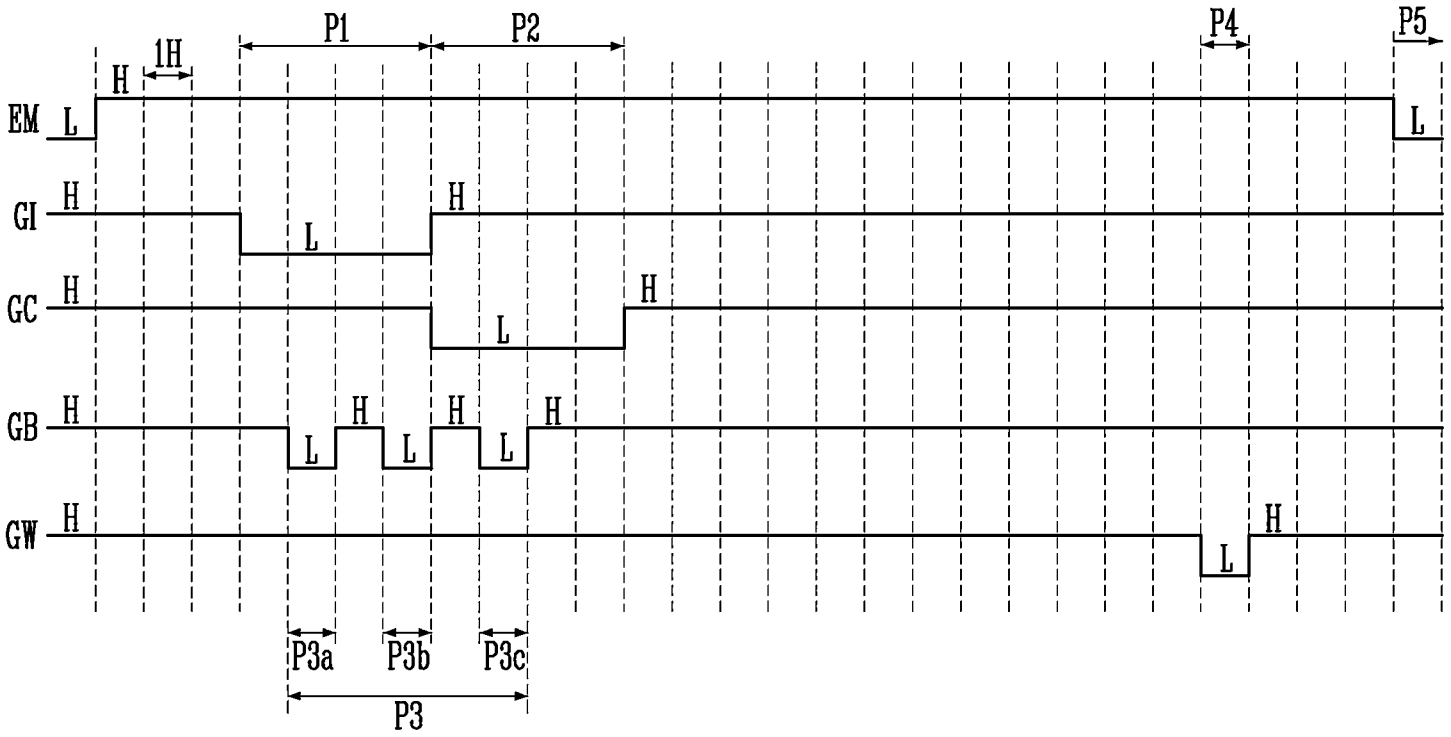
FIGS. 5A and 5B are waveform diagrams illustrating comparative examples for the operation of the pixel of FIG. 2A in a display-scan period.
Figure 5B:
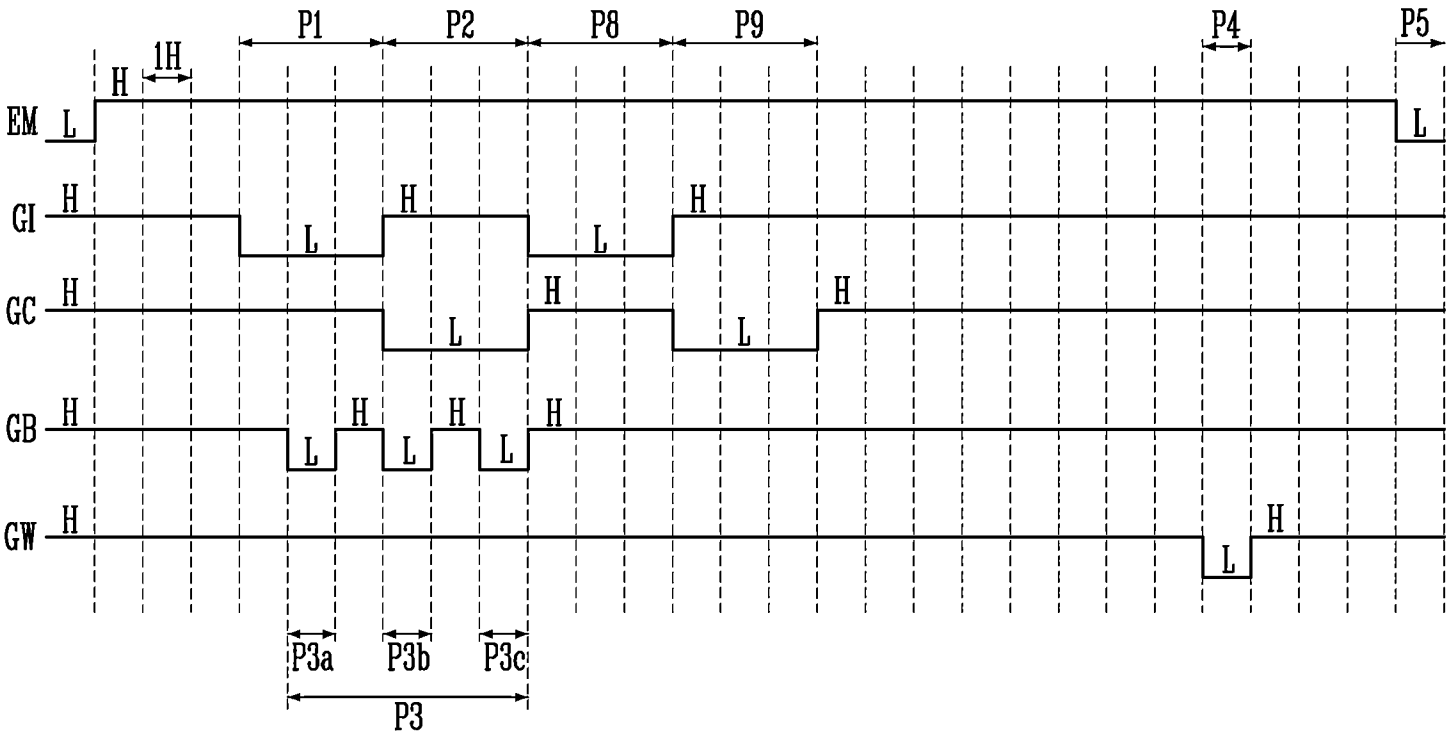

FIGS. 5A and 5B are waveform diagrams illustrating comparative examples for the operation of the pixel of FIG. 2A in a display-scan period.

First, referring to FIGS. 2A and 2B, 3, and 5A, compared to the display-scan period DSP of FIG. 3, in a display-scan period DSP_1 of FIG. 5A, each of a first period P1 in which a third scan signal GI has a gate-on level and a second period P2 in which a second scan signal GC has a gate-on level may correspond to 4 horizontal periods (4H). That is, each of the second scan signal GC and the third scan signal GI may have a gate-on level (or low level L) in accordance with 4 horizontal periods (4H).

In an embodiment, as described above with reference to FIG. 3, where each of the first period in which each of the first period P1 in which the third scan signal GI has a gate-on level and the second period P2 in which the second scan signal GC has a gate-on level secures an interval corresponding to 3 horizontal periods (3H), the initialization operation for the pixel PX may be sufficiently performed. In such an embodiment, when the first period P1 secures the interval corresponding to 3 horizontal periods (3H), an operation of initializing the first node N1 (or the gate electrode of the first transistor T1) to the voltage of initialization power VINT may be sufficiently performed. In such an embodiment, where the second period P2 secures the interval corresponding to 3 horizontal periods (3H), an operation of initializing the second node N2 to the voltage of the reference power VREF and an operation of sampling or compensating the threshold voltage of the first transistor T1 may be sufficiently performed.

In a case, where the length of each of the first period P1 and the second period P2 is equal to or greater than 4 horizontal periods (4H), the length of the initialization operation period is increased, as described above with reference to FIG. 3, and thus the influence of bias on the first transistor T1 may be increased. Accordingly, because a shift in the threshold voltage of the first transistor T1 may be more severe, a luminance deviation in the display-scan period DSP and the self-scan period SSP and/or a luminance deviation depending on the image refresh rate and/or a luminance deviation depending on the image refresh rate may be deteriorated, which will be described in detail later with reference to FIGS. 7A, 7B, 8A, and 8B.

Next, referring to FIGS. 2A and 2B, 3, and 5B, compared to the display-scan period DSP of FIG. 3, a display-scan period DSP_2 of FIG. 5B may further include an eighth period P8 in which a third scan signal GI has a gate-on level and a ninth period P9 in which a second scan signal GC has a gate-on level. That is, the third scan signal GI has a gate-on level (or low level L) during the eighth period P8, and the second scan signal GC may have a gate-on level (or low level L) during the ninth period P9. In this case, the operation of the pixel PX in the eighth period P8 and the operation of the pixel PX in the ninth period P9 in the display-scan period DSP_2 of FIG. 5B are substantially the same as the operation of the pixel PX in the first period P1 and the operation of the pixel PX in the second period P2 in the display-scan period DSP, described above with reference to FIG. 3, and thus any repetitive detailed descriptions thereof will be omitted.

In this case, similar to the display-scan period DSP_1 of FIG. 5A, the display-scan period DSP_2 of FIG. 5B may have a relatively long initialization operation period. The display-scan period DSP_2 of FIG. 5B may have an initialization operation period that is relatively lengthened due to the eighth period P8 in which the first node N1 (or the gate electrode of the first transistor T1) is to be initialized to the voltage of the initialization power VINT and the ninth period P9 in which the operation of initializing the second node N2 to the voltage of the reference power VREF and the operation of sampling or compensating the threshold voltage of the first transistor T1 are to be performed. Accordingly, depending on the voltages of the initialization power VINT and the reference power VREF supplied to the pixel PX in accordance with signals supplied for the initialization operation, for example, the second scan signal GC and the third scan signal GI having a gate-on level, the influence of on-bias on the first transistor T1 may be increased. Therefore, as described above with reference to FIG. 5A, a luminance deviation in the display-scan period DSP and the self-scan period SSP and/or a luminance deviation depending on the image refresh rate may be deteriorated, which will be described in detail later with reference to FIGS. 7A, 7B, 8A, and 8B.

Figure 6A:
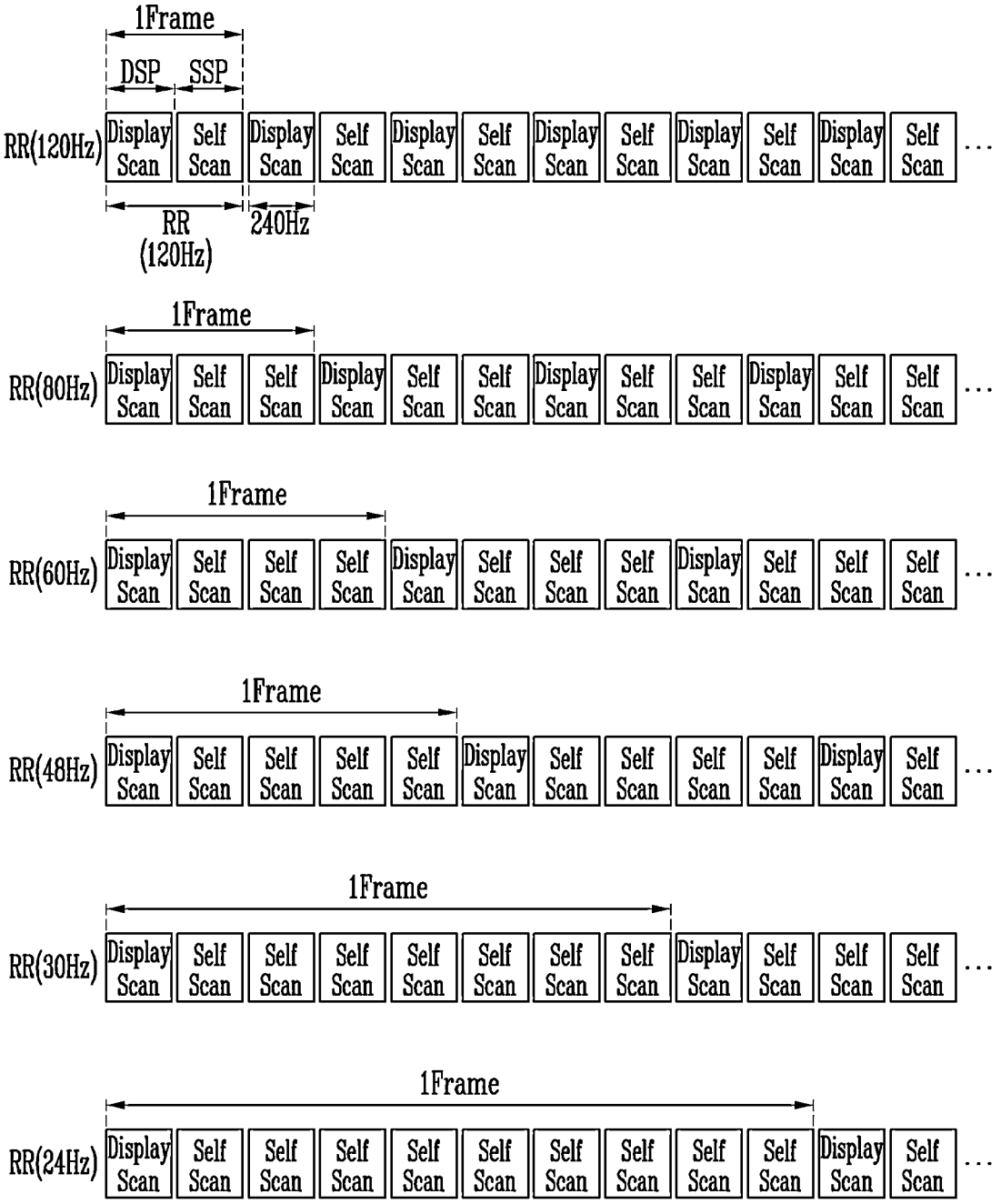
FIG. 6A is a conceptual diagram illustrating an embodiment of a method of driving a display device depending on an image refresh rate.
Figure 6B:
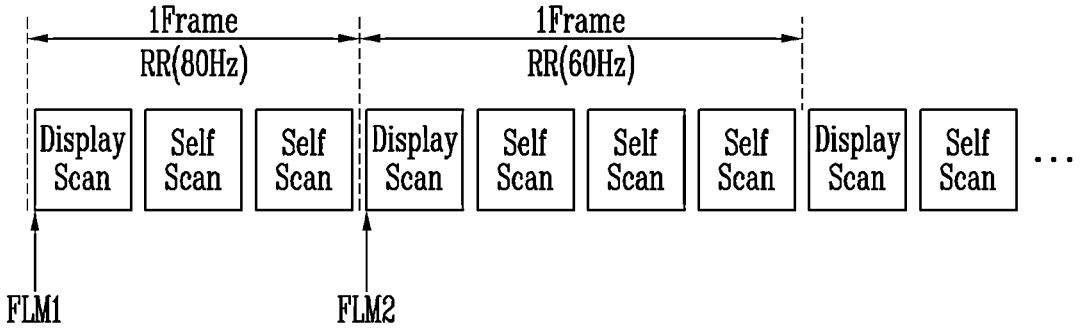
FIG. 6B is a diagram illustrating an embodiment of a method of driving a display device depending on an image refresh rate.

FIG. 6A is a conceptual diagram illustrating an embodiment of a method of driving a display device depending on an image refresh rate. FIG. 6B is a diagram illustrating an embodiment of a method of driving a display device depending on an image refresh rate.

Referring to FIGS. 1, 2A, 3, 4, and 6A, the pixel PX may perform an operation substantially the same as that of the pixel PX described above with reference to FIG. 3, during the display-scan period DSP, and may perform an operation substantially the same as that of the pixel PX described above with reference to FIG. 4, during the self-scan period SSP.

In an embodiment, depending on the image refresh rate RR, the output frequencies of the first scan signal GW, the second scan signal GC, and the third scan signal GI may vary. In an embodiment, for example, the first scan signal GW, the second scan signal GC, and the third scan signal GI may be output at the same frequency (second frequency) as the image refresh rate RR.

In an embodiment, regardless of the image refresh rate RR, the fourth scan signal GB and the emission control signal EM may be output at a constant frequency (a first frequency). In an embodiment, for example, the output frequency of the fourth scan signal GB and the output frequency of the emission control signal EM may be set to twice the maximum refresh rate of the display device 1000.

In an embodiment, the lengths of the display-scan period DSP and the self-scan period SSP may be substantially equal to each other. However, the number of self-scan periods SSP included in one frame period may be determined based on the image refresh rate RR.

In an embodiment, as illustrated in FIG. 6A, when the display device 1000 is driven at an image refresh rate RR of 120 Hz, one frame period may include one display-scan period DSP and one self-scan period SSP. Accordingly, when the display device 1000 is driven at the image refresh rate RR of 120 Hz, pixels PX may alternately repeat emission and non-emission twice during one frame period.

In such an embodiment, when the display device 1000 is driven at an image refresh rate RR of 80 Hz, one frame period may include one display-scan period DSP and two consecutive self-scan periods SSP. Accordingly, when the display device 1000 is driven at the image refresh rate RR of 80 Hz, the pixels PX may alternately repeat emission and non-emission three times during one frame period.

In such an embodiment, the display device 1000 may be driven at various driving frequencies of 60 Hz, 48 Hz, 30 Hz, 24 Hz, and 1 Hz by adjusting the number of self-scan periods SSP included in one frame period. In such an embodiment, the display device 1000 may support various image refresh rates RR with frequencies corresponding to aliquots of the first frequency.

In such an embodiment, as the driving frequency decreases, the number of self-scan periods SSP increases, and thus operations of initializing light-emitting elements LD respectively included in the pixels PX may be performed. Accordingly, the pixels PX may show more uniform luminance characteristics.

In an embodiment, as illustrated in FIG. 6B, the display device 1000 may display an image using different start pulses FLM1 and FLM2 depending on the image refresh rate RR. In an embodiment, for example, when the display device 1000 is driven at an image refresh rate RR of 80 Hz, the display device 1000 displays an image using the first start pulse FLM1, whereas when the display device 1000 is driven at an image refresh rate RR of 60 Hz, the display device 1000 may display an image using the second start pulse FLM2. In such an embodiment, because the first scan driver 200, the second scan driver 300, and the third scan driver 400 are driven at different frequencies (or a second frequency) depending on the image refresh rate RR, the first start pulse FLM1 and the second start pulse FLM2 may include a first scan start pulse and a second scan start pulse which are different from each other.

Figure 7A:
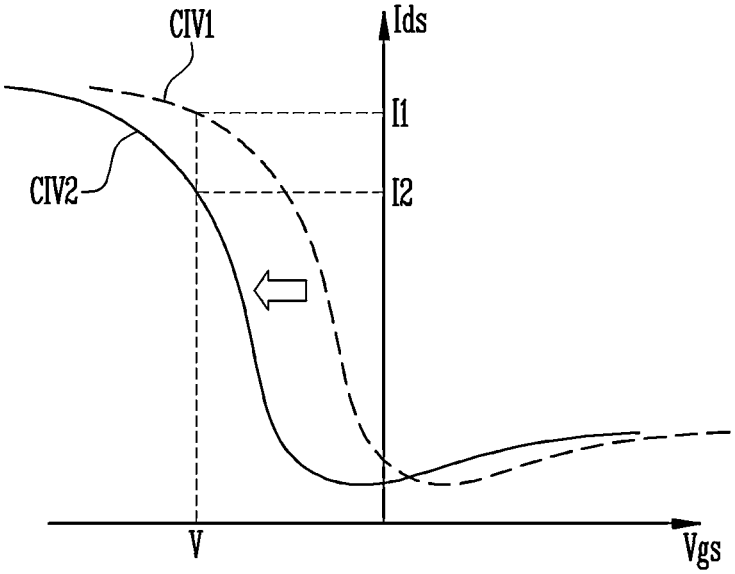
FIGS. 7A and 7B are graphs illustrating the characteristics of a first transistor included in the pixel of FIG. 2A.
Figure 7B:
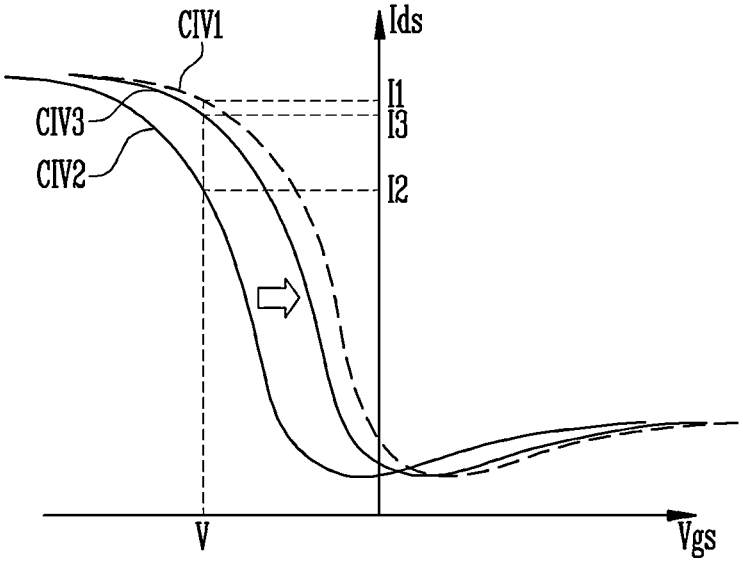
Figure 8A:
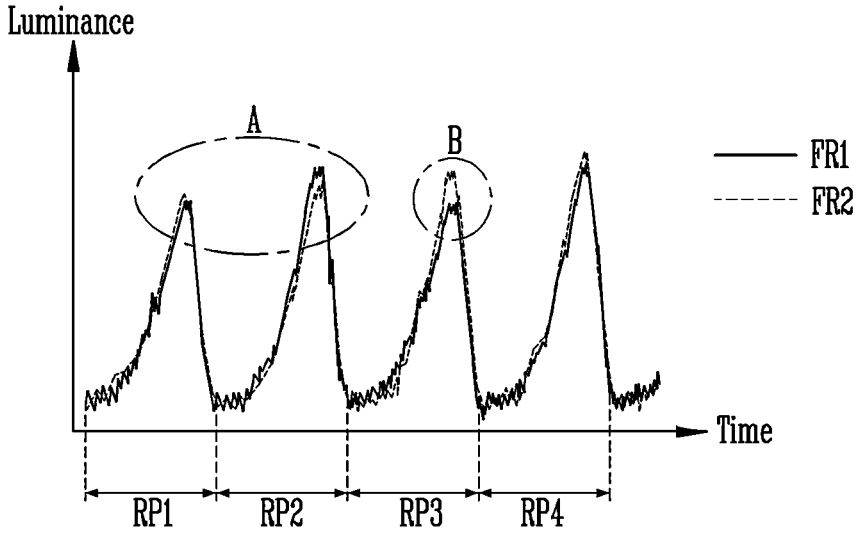
FIGS. 8A and 8B are graphs illustrating time versus luminance of the pixel of FIG. 2A.
Figure 8B:
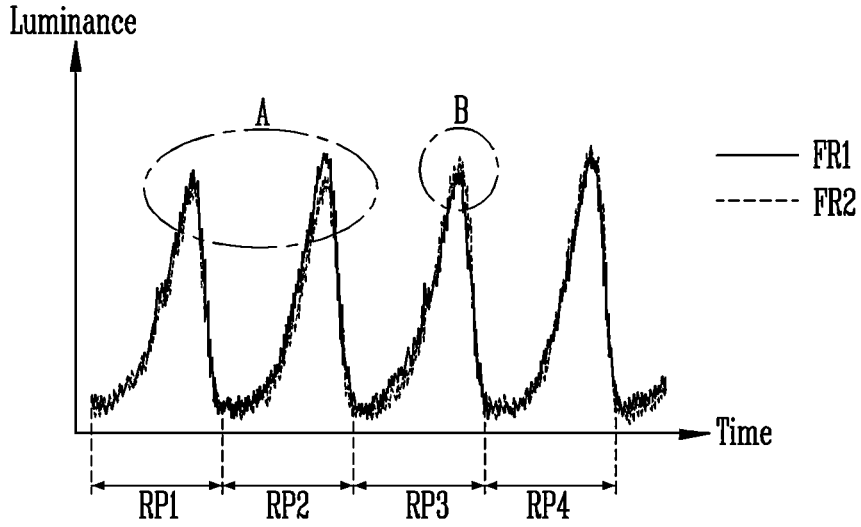
Figure 9A:
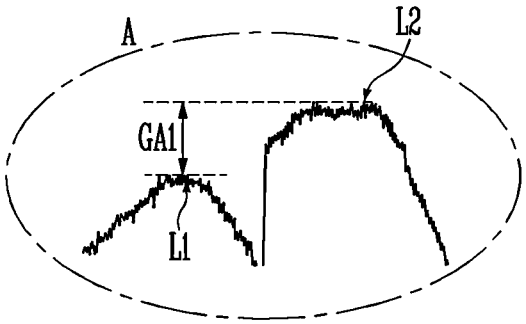
FIGS. 9A and 9B are enlarged views of the encircled portions A and B of FIG. 8A, respectively.
Figure 9B:
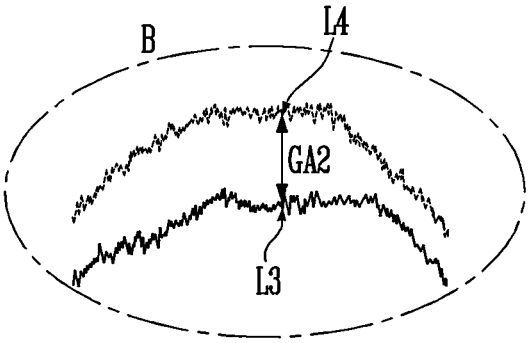
Figure 9C:
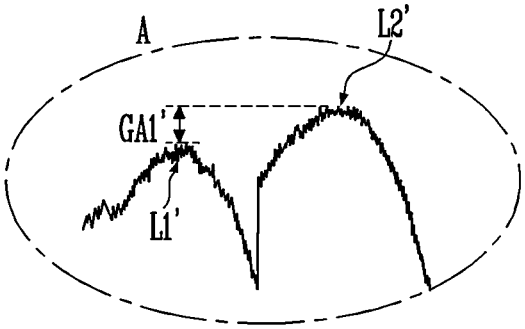
FIGS. 9C and 9D are enlarged views of the encircled portions A and B of FIG. 8B, respectively.
Figure 9D:
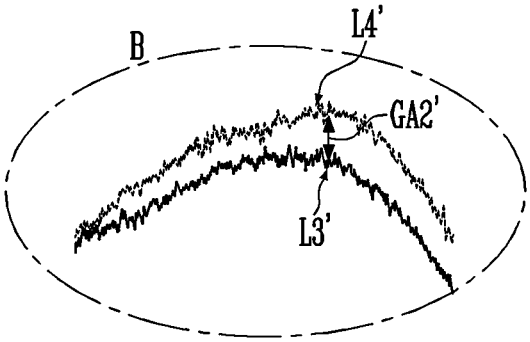

FIGS. 7A and 7B are graphs illustrating the characteristics of a first transistor included in the pixel of FIG. 2A. FIGS. 8A and 8B are graphs illustrating time versus luminance of the pixel of FIG. 2A. FIGS. 9A and 9B are enlarged views of the encircled portions A and B of FIG. 8A, respectively. FIGS. 9C and 9D are enlarged views of the encircled portions A and B of FIG. 8B, respectively.

Particularly, FIG. 8A illustrates a time versus luminance graph of a pixel PX (see FIG. 2A) appearing when the display device 1000 (see FIG. 1) drives the pixel PX (see FIG. 2A) during the display-scan period DSP_1 according to the comparative example of FIG. 5A or the display-scan period DSP_2 according to the comparative example of FIG. 5B, in one frame, and FIG. 8B illustrates a time versus luminance graph of the pixel PX (see FIG. 2A) appearing when the display device 1000 (see FIG. 1) drives the pixel PX (see FIG. 2A) during the display-scan period DSP according to an embodiment of the disclosure in one frame.

Further, in FIGS. 8A and 8B, a luminance graph when the image refresh rate is a first driving frequency FR1 and a luminance graph when the image refresh rate is a second driving frequency FR2 are respectively illustrated. Here, the first driving frequency FR1 may be higher than the second driving frequency FR2. In an embodiment, for example, the first driving frequency FR1 may be 120 Hz, and the second driving frequency may be 60 Hz. When the first driving frequency FR1 is 120 Hz, a first refresh period RP1 and a third refresh period RP3 may correspond to a display-scan period DSP (DSP_1 or DSP_2) when the display device 1000 (see FIG. 1) is driven at the first driving frequency FR1, and a second refresh period RP2 and a fourth refresh period RP4 may correspond to a self-scan period SSP when the display device 1000 (see FIG. 1) is driven at the first driving frequency FR1. In this case, the first and second refresh periods RP1 and RP2 may form one frame, and the third and fourth refresh periods RP3 and RP4 may form one frame. Similar to this, when the second driving frequency FR2 is 60 Hz, the first refresh period RP1 may correspond to the display-scan period DSP (DSP_1 or DSP_2) when the display device 1000 (see FIG. 1) is driven at the second driving frequency FR2, and the second to fourth refresh periods RP2, RP3, and RP4 may correspond to the self-scan period SSP when the display device 1000 (see FIG. 1) is driven at the second driving frequency FR2. That is, in this case, the refresh periods RP1, RP2, RP3, and RP4 may form one frame.

First, referring to FIGS. 2A, 3, 4, 5A, 5B, and 7A, a first current curve CIV1 indicates ideal voltage-current characteristics of the first transistor T1 (i.e., the relationship between a gate-source voltage Vgs between the gate electrode and the source electrode of the first transistor T1 and a driving current Ids corresponding thereto).

A second current curve CIV2 indicates the voltage-current characteristics of the first transistor T1, in which the threshold voltage of the first transistor T1 is shifted due to the influence of bias caused by the supply of signals for an initialization operation during the display period DSP (DSP_1 or DSP_2). In this case, as the threshold voltage is shifted, the value of the driving current Ids corresponding to the same gate-source voltage Vgs may vary. In an embodiment, for example, in accordance with the voltage-current characteristics of the first transistor T1 depending on the first current curve CIV1, the driving current Ids corresponding to the gate-source voltage Vgs of a specific voltage V has a first current value I1, whereas, in accordance with the voltage-current characteristics of the first transistor T1 depending on the second current curve CIV2, the driving current Ids corresponding to the gate-source voltage Vgs of a specific voltage V has a second current value I2 less than the first current value I1. As described above, when the threshold voltage is shifted due to the influence of bias, the magnitude of the driving current Ids is decreased, whereby luminance may be reduced.

In an embodiment, as described above with reference to FIGS. 3, 5A, and 5B, depending on the voltages of the initialization power VINT and the reference power VREF supplied to the pixel PX in accordance with signals supplied for the initialization operation during the display-scan period DSP (DSP_1 or DSP_2), for example, the second scan signal GC and the third scan signal GI having a gate-on level, the influence of bias (e.g., on-bias) on the first transistor T1 may be increased. In this case, as the length of a period in which the second scan signal GC and/or the third scan signal GI are maintained at a gate-on level becomes greater, a shift in the threshold voltage attributable to the above-described influence of bias may become severe.

In a case, where the lengths of the first period P1 and/or the second period P2 are increased as described above with reference to FIG. 5A, or when the scan period DSP_2 further includes the eighth period P8 and the ninth period P9 for performing an initialization operation or a compensation operation, as described above with reference to FIG. 5B, a shift in the threshold voltage attributable to the influence of bias may become severe. In this case, the degree to which luminance is decreased depending on the shift in threshold voltage may become further severe.

As shown in FIG. 9A, for example, when the display device 1000 (see FIG. 1) drives the pixel PX at the first driving frequency FR1 during the display-scan period DSP (DSP_1 or DSP_2) according to the comparative examples of FIGS. 5A and 5B, peak luminance has a first luminance value L1 lower than an ideal luminance value during the first refresh period RP1 (i.e., the display-scan period DSP_1 or DSP_2), as illustrated in FIG. 8A.

In an embodiment, when the display device 1000 (see FIG. 1) drives the pixel PX at the first driving frequency FR1 during the display-scan period DSP as shown in FIG. 3, peak luminance may have a first luminance value L1' having a relatively small difference from an ideal luminance value during the first refresh period RP1 (i.e., the display-scan period DSP), as illustrated in FIG. 8B. In such an embodiment, as described above, when the pixel PX is driven during the display-scan period DSP as shown in FIG. 3, a shift in threshold voltage attributable to the influence of bias is less than that when the pixel PX is driven during the display-scan period DSP_1 or DSP_2 according to the comparative example of FIG. 5A or 5B, such that a luminance deviation (e.g., a luminance deviation from an ideal luminance value) in the display-scan period DSP may be minimized.

Next, referring to FIG. 7B, a third current curve CIV3 indicates voltage-current characteristics of the first transistor T1 in which the threshold voltage of the first transistor T1 is back-shifted due to the influence of back bias occurring when a driving current Ids flows through the first transistor T1 after an emission period (or a first emission period) of the display-scan period DSP (DSP_1 or DSP_2) or an emission period (or a second emission period) of the self-scan period SSP. In this case, as the threshold voltage is back-shifted, the value of the driving current Ids corresponding to the same gate-source voltage Vgs may vary. In accordance with the voltage-current characteristics of the first transistor T1 depending on the second current curve CIV2, the driving current Ids corresponding to the gate-source voltage Vgs of a specific voltage V has a second current value I2, whereas, in accordance with the voltage-current characteristics of the first transistor T1 depending on the third current curve CIV3, the driving current Ids corresponding to the gate-source voltage Vgs of a specific voltage V may have a third current value I3 greater than the second current value I2. In this case, as the threshold voltage is back shifted, the voltage-current characteristics (e.g., voltage-current characteristics depending on the third current curve CIV3) of the first transistor T1 approach the ideal voltage-current characteristics (e.g., voltage-current characteristics depending on the first current curve CIV1) of the first transistor T1.

Here, when one frame includes one display-scan period DSP (DSP_1 or DSP_2) and one self-scan period SSP depending on the image refresh rate of the display device 1000 (see FIG. 1), the self-refresh period SSP does not include a period (e.g., the first period P1) used for an operation for initializing the first node N1 (or the gate electrode of the first transistor T1) and a period (e.g., the second period P2) used for an operation of initializing the second node N2 and sampling or compensating a threshold voltage, and includes only an emission period (e.g., a seventh period P7), and thus the above-described back-shift in threshold voltage may occur during the self-scan period SSP. Accordingly, a luminance deviation may occur in the display-scan period DSP (DSP_1 or DSP_2) and the self-scan period SSP, and a luminance deviation depending on the image refresh rate may occur.

In a case, where the display device 1000 (see FIG. 1) drives the pixel PX at the first driving frequency FR1 during the display-scan period DSP1 or DSP_2 according to the comparative example of FIG. 5A or 5B, peak luminance has a first luminance value L1 during the first refresh period RP1 (i.e., the display-scan period DSP1_or DSP_2), as illustrated in FIGS. 8A and 9A, and the value of the peak luminance may have a second luminance value L2 higher than the first luminance value L1 due to the above-described back-shift in threshold voltage during the second refresh period RP2 (i.e., the self-scan period SSP). In this case, a luminance deviation in the display-scan period DSP_1 or DSP_2 (or the first refresh period RP1) and the self-scan period SSP (or the second refresh period RP2) may have a first difference value GA1 which is relatively large.

In an embodiment, when the display device 1000 (see FIG. 1) drives the pixel PX at the first driving frequency FR1 during the display-scan period DSP as shown in FIG. 3, peak luminance has a first luminance value L1' during the first refresh period RP1 (i.e., the display-scan period DSP), as illustrated in FIGS. 8B and 9C, and the value of the peak luminance may have a second luminance value L2' higher than the first luminance value L1' due to the above-described back-shift in threshold voltage during the second refresh period RP2 (i.e., the self-scan period SSP). In such an embodiment, as described above with reference to FIGS. 7A and 8A, the first luminance value L1' has a relatively small difference from an ideal luminance value, wherein a luminance deviation in the display-scan period DSP (or the first refresh period RP1) and the self-scan period SSP (or the second refresh period RP2) may have a first difference value GA1' which is less than the first difference value GA1 of FIG. 9A. In an embodiment, as described above, when the pixel PX is driven during the display-scan period DSP, a shift in threshold voltage attributable to the influence of bias during the display-scan period DSP is less than that when the pixel PX is driven during the display-scan period DSP_1 or DSP_2 according to the comparative example of FIG. 5A or 5B, such that a luminance deviation in the display-scan period DSP and the self-scan period SSP may be minimized.

In a case, when the display device 1000 (see FIG. 1) drives the pixel PX at the first driving frequency FR1 during the display-scan period DSP (DSP_1 or DSP_2) according to the comparative example of FIG. 5A or 5B, peak luminance may have a third luminance value L3 due to a shift in threshold voltage attributable to the influence of bias occurring in the display-scan period DSP_1 or DSP_2 during a third refresh period RP3 driven as the display-scan period DSP_1 or DSP_2, as illustrated in FIGS. 8A and 9B. In this case, when the display device 1000 (see FIG. 1) drives the pixel PX at the second driving frequency FR2 during the display-scan period DSP_1 or DSP_2 according to the comparative example of FIG. 5A or 5B, peak luminance may have a fourth luminance value L4 due to a back shift in threshold voltage attributable to the influence of back bias during the third refresh period RP3 driven as the self-scan period SSP, as illustrated in FIGS. 8A and 9B. In this case, as described above, according to the comparative example of FIG. 5A or 5B, a shift in threshold voltage attributable to the influence of bias is relatively large, and thus a luminance deviation (e.g., a second difference value GA2) in the third refresh period RP3 between the first driving frequency FR1 and the second driving frequency FR2 may be relatively large.

In an embodiment, when the display device 1000 (see FIG. 1) drives the pixel PX at the first driving frequency FR1 during the display-scan period DSP as shown in FIG. 3, peak luminance may have a third luminance value L3' because a shift in threshold voltage attributable to the influence of bias occurring in the display-scan period DSP is minimized during the third refresh period RP3 driven as the display-scan period DSP, as illustrated in FIGS. 8B and 9D. Here, since the shift in threshold voltage is minimized due to driving during the display-scan period DSP of FIG. 3, the third luminance value L3' of FIG. 9D may have a value greater than the third luminance value L3 of FIG. 9B (i.e., the third luminance value L3' may have a relatively small difference from an ideal luminance value). In an embodiment, when the display device 1000 (see FIG. 1) drives the pixel PX at the second driving frequency FR2 during the display-scan period DSP as shown in FIG. 3, peak luminance may have a fourth luminance value L4' due to a back shift in threshold voltage attributable to the influence of back bias during the third refresh period RP3 driven as the self-scan period SSP, as illustrated in FIGS. 8B and 9D. In an embodiment, as described above and as shown in FIG. 3, a shift in threshold voltage attributable to the influence of bias may be minimized, and thus a luminance deviation (e.g., a second difference value GA2') in the third refresh period RP3 between the first driving frequency FR1 and the second driving frequency FR2 may be minimized.

As described above with reference to FIGS. 1 to 3, 4, 5A, 5B, 7A, 7B, 8A, 8B, and 9A to 9D, an embodiment of the display device 1000 according to the disclosure may minimize the length of a period in which the operation of initializing or compensating the pixel PX is to be performed depending on the driving in the display-scan period DSP of FIG. 3, such that a luminance deviation in the display-scan period DSP and the self-scan period SSP and/or a luminance deviation depending on an image refresh rate may be substantially reduced or effectively minimized.

The invention should not be construed as being limited to the embodiments set forth herein. Rather, these embodiments are provided so that this disclosure will be thorough and complete and will fully convey the concept of the invention to those skilled in the art.

While the invention has been particularly shown and described with reference to embodiments thereof, it will be understood by those of ordinary skill in the art that various changes in form and details may be made therein without departing from the spirit or scope of the invention as defined by the following claims.

What is claimed is:

1. A display device, comprising: a display panel including a pixel coupled to a first scan line, a second scan line, a third scan line, a fourth scan line, an emission control line, and a data line; a scan driver which supplies a first scan signal to the first scan line, supplies a second scan signal to the second scan line, supplies a third scan signal to the third scan line, and supplies a fourth scan signal to the fourth scan line; an emission driver which supplies an emission control signal to the emission control line; a data driver which supplies a data signal to the data line; and a timing controller which controls driving of the scan driver, the emission driver, and the data driver, wherein each of the second scan signal and the third scan signal has a gate-on level during a partial period of one frame, and wherein each of the second scan signal and the third scan signal is maintained at a gate-off level during a remaining period of the one frame, other than the partial period, wherein the scan driver comprises: a first scan driver which supplies the first scan signal to the first scan line at a second frequency corresponding to an image refresh rate of the pixel; a second scan driver which supplies the second scan signal to the second scan line at the second frequency; a third scan driver which supplies the third scan signal to the third scan line at the second frequency; and a fourth scan driver which supplies the fourth scan signal to the fourth scan line at a first frequency different from the second frequency, the emission driver supplies the emission control signal to the emission control line at the first frequency, and the data driver supplies the data signal to the data line at the second frequency.

2. The display device according to claim 1, wherein: the one frame includes a display-scan period and at least one self-scan period, the second scan signal has a gate-on level during a first period of the display-scan period, and the second scan signal is maintained at a gate-off level during a remaining period of the display-scan period, other than the first period, and the third scan signal has a gate-on level during a second period of the display-scan period, and the third scan signal is maintained at a gate-off level during a remaining period of the display-scan period, other than the second period.

3. The display device according to claim 2, wherein the first period and the second period are successive to each other in the display-scan period.

4. The display device according to claim 2, wherein a width of each of the first period and the second period corresponds to 3 horizontal periods.

5. The display device according to claim 2, wherein
the fourth scan signal has a gate-on level during a partial period of a third period of the display-scan period, and
the fourth scan signal is maintained at a gate-off level during a remaining period of the display-scan period, other than the partial period of the third period.

6. The display device according to claim 5, wherein the first period and the third period overlap each other.

7. The display device according to claim 5, wherein the second period and the third period overlap each other.

8. The display device according to claim 5, wherein:
the third period includes a first sub-period, a second sub-period, and a third sub-period, and
the fourth scan signal has a gate-on level during the first to third sub-periods and has a gate-off level in a remaining period of the third period, other than the first to third sub-periods.

9. The display device according to claim 5, wherein
the fourth scan signal has a gate-on level during a partial period of a sixth period of each of the at least one self-scan period,
the fourth scan signal is maintained at a gate-off level during a remaining period of each of the at least one self-scan period, other than the partial period of the sixth period.

10. The display device according to claim 2, wherein:
the first scan signal has a gate-on level during a fourth period of the display-scan period,
the first scan signal is maintained at a gate-off level during a remaining period of the display-scan period, other than the fourth period, and
the data signal is written to the pixel during the display-scan period.

11. The display device according to claim 2, wherein the second scan signal and the third scan signal are maintained at a gate-off level during each of the at least one self-scan period.

12. The display device according to claim 2, wherein the image refresh rate decreases as a number of the at least one self-scan period in the one frame increases.

13. The display device according to claim 1, wherein the second frequency corresponds to an aliquot of the first frequency.

14. The display device according to claim 1, wherein the pixel comprises:

a first transistor including a gate electrode coupled to a first node, a first electrode coupled to a first power line, and a second electrode coupled to a third node;

a first capacitor coupled between the first power line and a second node;

a second capacitor coupled between the first node and the second node;

a second transistor including a first electrode coupled to the data line, a second electrode coupled to the second node, and a gate electrode coupled to the first scan line;

a third transistor including a first electrode coupled to the first node, a second electrode coupled to the third node, and a gate electrode coupled to the second scan line;

a fourth transistor including a first electrode coupled to the first node, a second electrode coupled to an initialization power line, and a gate electrode coupled to the third scan line;

a fifth transistor including a first electrode coupled to the second node, a second electrode coupled to a reference power line, and a gate electrode coupled to the second scan line;

a sixth transistor including a first electrode coupled to the third node and a gate electrode coupled to the emission control line;

a seventh transistor including a first electrode coupled to the initialization power line and a gate electrode coupled to the fourth scan line; and a light-emitting element including a first electrode coupled to a second electrode of the sixth transistor and to a second electrode of the seventh transistor and a second electrode coupled to a second power line.

15. A method of driving a display device, the method comprising: supplying a first scan signal to a first scan line; supplying a second scan signal to a second scan line; supplying a third scan signal to a third scan line; supplying a fourth scan signal to a fourth scan line; supplying an emission control signal to an emission control line; and supplying a data signal to a pixel through a data line, wherein each of the second scan signal and the third scan signal has a gate-on level during a partial period of one frame, and wherein each of the second scan signal and the third scan signal is maintained at a gate-off level during a remaining period of one frame, other than the partial period, wherein the supplying the first scan signal comprises supplying the first scan signal to the first scan line at a second frequency corresponding to an image refresh rate of the pixel, the supplying the second scan signal comprises supplying the second scan signal to the second scan line at the second frequency, the supplying the third scan signal comprises supplying the third scan signal to the third scan line at the second frequency, the supplying the fourth scan signal comprises supplying the fourth scan signal to the fourth scan line at a first frequency different from the second frequency, the supplying the emission control signal comprises the emission control signal to the emission control line at the first frequency, and the supplying the data signal comprises supplying the data signal to the data line at the second frequency.

16. The method according to claim 15, wherein: the one frame includes a display-scan period and at least one self-scan period, the second scan signal has a gate-on level during a first period of the display-scan period, and the second scan signal is maintained at a gate-off level during a remaining period of the display-scan period, other than the first period, and the third scan signal has a gate-on level during a second period of the display-scan period, and the third scan signal is maintained at a gate-off level during a remaining period of the display-scan period, other than the second period.

17. The method according to claim 16, wherein a width of each of the first period and the second period corresponds to 3 horizontal periods.

18. The method according to claim 6, wherein:

the fourth scan signal has a gate-on level during a partial period of a third period of the display-scan period, the fourth scan signal is maintained at a gate-off level during a remaining period of the display-scan period, other than the partial period of the third period, the first period and the third period overlap each other, and the second period and the third period overlap each other.

* * * * *